US008115714B2

(12) United States Patent
Murai et al.

(10) Patent No.: US 8,115,714 B2
(45) Date of Patent: Feb. 14, 2012

(54) DISPLAY DEVICE AND METHOD OF DRIVING THE SAME

(75) Inventors: Atsuhito Murai, Osaka (JP); Kozo Takahashi, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 267 days.

(21) Appl. No.: 12/451,473

(22) PCT Filed: Jan. 28, 2008

(86) PCT No.: PCT/JP2008/051159
§ 371 (c)(1),
(2), (4) Date: Nov. 13, 2009

(87) PCT Pub. No.: WO2008/149569
PCT Pub. Date: Dec. 11, 2008

(65) Prior Publication Data

US 2010/0118058 A1 May 13, 2010

(30) Foreign Application Priority Data

Jun. 6, 2007 (JP) ..... 2007-150700

(51) Int. Cl.
*G09G 5/10* (2006.01)

(52) U.S. Cl. ..... 345/88; 345/79; 345/100

(58) Field of Classification Search ..... 345/87, 345/88, 89, 92, 96, 690; 349/106, 110
See application file for complete search history.

(56) References Cited

U.S. PATENT DOCUMENTS 4,775,861 A * 10/1988 Saito ..... 345/93
4,822,142 A * 4/1989 Yasui ..... 349/48
4,931,787 A * 6/1990 Shannon ..... 345/93
5,151,689 A * 9/1992 Kabuto et al. ..... 345/103
5,485,293 A * 1/1996 Robinder ..... 345/88
(Continued)

FOREIGN PATENT DOCUMENTS

JP 04-360127 12/1992
(Continued)

OTHER PUBLICATIONS

International Search Report.

*Primary Examiner* — Amare Mengistu
*Assistant Examiner* — Stacy Khoo
(74) *Attorney, Agent, or Firm* — Harness, Dickey & Pierce, P.L.C.

(57) ABSTRACT

In one embodiment of the present invention, an active-matrix type display unit, and a drive method thereof are disclosed. Gate-bus lines are provided at both top and bottom sides of each row. Two sub-pixels are formed at a region surrounded by two adjacent source-bus lines and two adjacent gate-bus lines. At the odd-numbered rows, for the left-side sub-pixel of those two sub-pixels, a scanning signal is supplied from the top-side gate-bus line, while a video signal is supplied from the left-side source-bus line. For the right-side sub-pixel, on the contrary, a scanning signal is supplied from the bottom-side gate-bus line, while a video signal is supplied from the right-side source-bus line. At the even-numbered rows, the gate-bus line from which a scanning signal is supplied is reversed to the case of the odd-numbered rows. The gate-bus lines are sequentially selected one by one, and all the video signal polarities are made the same during each horizontal scanning period.

9 Claims, 42 Drawing Sheets

U.S. PATENT DOCUMENTS

| | | | | |
|---|---|---|---|---|
| 6,075,505 | A | 6/2000 | Shiba et al. | |
| 6,552,707 | B1 * | 4/2003 | Fujiyoshi | 345/98 |
| 6,850,294 | B2 * | 2/2005 | Roh et al. | 349/106 |
| 7,847,775 | B2 * | 12/2010 | Yamazaki | 345/95 |
| 2008/0068516 | A1 | 3/2008 | Mori et al. | |

FOREIGN PATENT DOCUMENTS

| | | |
|---|---|---|
| JP | 05-265045 | 10/1993 |
| JP | 10-073843 | 3/1998 |
| JP | 10-142578 | 5/1998 |
| JP | 3504496 | 3/2004 |
| JP | 2008-070763 | 3/2008 |

* cited by examiner

Fig.10

| | | | | | | | | | | | | | | |
|---|---|---|---|---|---|---|---|---|---|---|---|---|---|---|
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| − | + | − | + | − | + | − | + | − | + | − | + | − | + | − |

Fig.11

| | | | | | | | | | | | | | | |
|---|---|---|---|---|---|---|---|---|---|---|---|---|---|---|
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| + | − | + | − | + | − | + | − | + | − | + | − | + | − | + |

Fig.15

| | | | | | | | | | | | | | | | |
|---|---|---|---|---|---|---|---|---|---|---|---|---|---|---|---|
| R | G | B | W | R | G | B | W | R | G | B | W | R | G | B | W |
| + | − | + | − | + | − | + | − | + | − | + | − | + | − | + | − |
| R | G | B | W | R | G | B | W | R | G | B | W | R | G | B | W |
| − | + | − | + | − | + | − | + | − | + | − | + | − | + | − | + |
| R | G | B | W | R | G | B | W | R | G | B | W | R | G | B | W |
| + | − | + | − | + | − | + | − | + | − | + | − | + | − | + | − |
| R | G | B | W | R | G | B | W | R | G | B | W | R | G | B | W |
| − | + | − | + | − | + | − | + | − | + | − | + | − | + | − | + |
| R | G | B | W | R | G | B | W | R | G | B | W | R | G | B | W |
| + | − | + | − | + | − | + | − | + | − | + | − | + | − | + | − |
| R | G | B | W | R | G | B | W | R | G | B | W | R | G | B | W |
| − | + | − | + | − | + | − | + | − | + | − | + | − | + | − | + |

Fig.16

| | | | | | | | | | | | | | | | |
|---|---|---|---|---|---|---|---|---|---|---|---|---|---|---|---|
| R | G | B | W | R | G | B | W | R | G | B | W | R | G | B | W |
| − | + | − | + | − | + | − | + | − | + | − | + | − | + | − | + |
| R | G | B | W | R | G | B | W | R | G | B | W | R | G | B | W |
| + | − | + | − | + | − | + | − | + | − | + | − | + | − | + | − |
| R | G | B | W | R | G | B | W | R | G | B | W | R | G | B | W |
| − | + | − | + | − | + | − | + | − | + | − | + | − | + | − | + |
| R | G | B | W | R | G | B | W | R | G | B | W | R | G | B | W |
| + | − | + | − | + | − | + | − | + | − | + | − | + | − | + | − |
| R | G | B | W | R | G | B | W | R | G | B | W | R | G | B | W |
| − | + | − | + | − | + | − | + | − | + | − | + | − | + | − | + |
| R | G | B | W | R | G | B | W | R | G | B | W | R | G | B | W |
| + | − | + | − | + | − | + | − | + | − | + | − | + | − | + | − |

Fig.23

| | | | | | | | | | | | | | | |
|---|---|---|---|---|---|---|---|---|---|---|---|---|---|---|
| R + | G − | B + | R − | G + | B − | R + | G − | B + | R − | G + | B − | R + | G − | B + |
| R | G | B | R | G | B | R | G | B | R | G | B | R | G | B |
| R − | G + | B − | R + | G − | B + | R − | G + | B − | R + | G − | B + | R − | G + | B − |
| R | G | B | R | G | B | R | G | B | R | G | B | R | G | B |
| R + | G − | B + | R − | G + | B − | R + | G − | B + | R − | G + | B − | R + | G − | B + |
| R | G | B | R | G | B | R | G | B | R | G | B | R | G | B |

Fig.24

| | | | | | | | | | | | | | | |
|---|---|---|---|---|---|---|---|---|---|---|---|---|---|---|
| R | G | B | R | G | B | R | G | B | R | G | B | R | G | B |
| R − | G + | B − | R + | G − | B + | R − | G + | B − | R + | G − | B + | R − | G + | B − |
| R | G | B | R | G | B | R | G | B | R | G | B | R | G | B |
| R + | G − | B + | R − | G + | B − | R + | G − | B + | R − | G + | B − | R + | G − | B + |
| R | G | B | R | G | B | R | G | B | R | G | B | R | G | B |
| R − | G + | B − | R + | G − | B + | R − | G + | B − | R + | G − | B + | R − | G + | B − |

Fig.25

| | | | | | | | | | | | | | | |
|---|---|---|---|---|---|---|---|---|---|---|---|---|---|---|
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |

Fig.26

| | | | | | | | | | | | | | | |
|---|---|---|---|---|---|---|---|---|---|---|---|---|---|---|
| R | G | B | R | G | B | R | G | B | R | G | B | R | G | B |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| R | G | B | R | G | B | R | G | B | R | G | B | R | G | B |
| + | − | + | − | + | − | + | − | + | − | + | − | + | − | + |

Fig.29

| | | | | | | | | | | | | | | |
|---|---|---|---|---|---|---|---|---|---|---|---|---|---|---|
| R | G | B | R | G | B | R | G | B | R | G | B | R | G | B |
| − | − | − | − | − | − | − | − | − | − | − | − | − | − | − |
| R | G | B | R | G | B | R | G | B | R | G | B | R | G | B |
| + | + | + | + | + | + | + | + | + | + | + | + | + | + | + |
| R | G | B | R | G | B | R | G | B | R | G | B | R | G | B |
| − | − | − | − | − | − | − | − | − | − | − | − | − | − | − |
| R | G | B | R | G | B | R | G | B | R | G | B | R | G | B |
| + | + | + | + | + | + | + | + | + | + | + | + | + | + | + |
| R | G | B | R | G | B | R | G | B | R | G | B | R | G | B |
| − | − | − | − | − | − | − | − | − | − | − | − | − | − | − |
| R | G | B | R | G | B | R | G | B | R | G | B | R | G | B |
| + | + | + | + | + | + | + | + | + | + | + | + | + | + | + |

Fig.30

| | | | | | | | | | | | | | | |
|---|---|---|---|---|---|---|---|---|---|---|---|---|---|---|
| R | G | B | R | G | B | R | G | B | R | G | B | R | G | B |
| + | + | + | + | + | + | + | + | + | + | + | + | + | + | + |
| R | G | B | R | G | B | R | G | B | R | G | B | R | G | B |
| − | − | − | − | − | − | − | − | − | − | − | − | − | − | − |
| R | G | B | R | G | B | R | G | B | R | G | B | R | G | B |
| + | + | + | + | + | + | + | + | + | + | + | + | + | + | + |
| R | G | B | R | G | B | R | G | B | R | G | B | R | G | B |
| − | − | − | − | − | − | − | − | − | − | − | − | − | − | − |
| R | G | B | R | G | B | R | G | B | R | G | B | R | G | B |
| + | + | + | + | + | + | + | + | + | + | + | + | + | + | + |
| R | G | B | R | G | B | R | G | B | R | G | B | R | G | B |
| − | − | − | − | − | − | − | − | − | − | − | − | − | − | − |

Fig.32

| | | | | | | | | | | | | | | |
|---|---|---|---|---|---|---|---|---|---|---|---|---|---|---|
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| − | + | − | + | − | + | − | + | − | + | − | + | − | + | − |
| R | G | B | R | G | B | R | G | B | R | G | B | R | G | B |
| − | + | − | + | − | + | − | + | − | + | − | + | − | + | − |

Fig.33

| | | | | | | | | | | | | | | |
|---|---|---|---|---|---|---|---|---|---|---|---|---|---|---|
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| + | − | + | − | + | − | + | − | + | − | + | − | + | − | + |
| R | G | B | R | G | B | R | G | B | R | G | B | R | G | B |
| + | − | + | − | + | − | + | − | + | − | + | − | + | − | + |

Fig.35

| | | | | | | | | | | | | | | |
|---|---|---|---|---|---|---|---|---|---|---|---|---|---|---|
| R | G | B | R | G | B | R | G | B | R | G | B | R | G | B |
| − | − | + | + | − | − | + | + | − | − | + | + | − | − | + |
| R | G | B | R | G | B | R | G | B | R | G | B | R | G | B |
| − | − | + | + | − | − | + | + | − | − | + | + | − | − | + |
| R | G | B | R | G | B | R | G | B | R | G | B | R | G | B |
| − | − | + | + | − | − | + | + | − | − | + | + | − | − | + |
| R | G | B | R | G | B | R | G | B | R | G | B | R | G | B |
| − | − | + | + | − | − | + | + | − | − | + | + | − | − | + |
| R | G | B | R | G | B | R | G | B | R | G | B | R | G | B |
| − | − | + | + | − | − | + | + | − | − | + | + | − | − | + |
| R | G | B | R | G | B | R | G | B | R | G | B | R | G | B |
| − | − | + | + | − | − | + | + | − | − | + | + | − | − | + |

Fig.36

| | | | | | | | | | | | | | | |
|---|---|---|---|---|---|---|---|---|---|---|---|---|---|---|
| R | G | B | R | G | B | R | G | B | R | G | B | R | G | B |
| + | + | − | − | + | + | − | − | + | + | − | − | + | + | − |
| R | G | B | R | G | B | R | G | B | R | G | B | R | G | B |
| + | + | − | − | + | + | − | − | + | + | − | − | + | + | − |
| R | G | B | R | G | B | R | G | B | R | G | B | R | G | B |
| + | + | − | − | + | + | − | − | + | + | − | − | + | + | − |
| R | G | B | R | G | B | R | G | B | R | G | B | R | G | B |
| + | + | − | − | + | + | − | − | + | + | − | − | + | + | − |
| R | G | B | R | G | B | R | G | B | R | G | B | R | G | B |
| + | + | − | − | + | + | − | − | + | + | − | − | + | + | − |
| R | G | B | R | G | B | R | G | B | R | G | B | R | G | B |
| + | + | − | − | + | + | − | − | + | + | − | − | + | + | − |

DISPLAY DEVICE AND METHOD OF DRIVING THE SAME

TECHNICAL FIELD

The present invention relates to an active matrix-type display device and a method of driving the same.

BACKGROUND ART

Conventionally, an active matrix-type liquid crystal display device having a TFT (Thin Film Transistor) as a switching element is known. The liquid crystal display device includes a liquid crystal panel constructed by two insulating substrates which face each other. On one of the substrates of the liquid crystal panel, gate bus lines (scanning signal lines) and source bus lines (video signal lines) are provided in a lattice shape, and TFTs are provided near the crossing points of the gate bus lines and the source bus lines. The TFT is configured by a gate electrode, a source electrode, and a drain electrode. The gate electrode is connected to the gate bus line, the source electrode is connected to the source bus line, and the drain electrode is connected to any of pixel electrodes disposed in a matrix on the substrate for forming an image. On the other substrate of the liquid crystal panel, electrodes (hereinafter, referred to as "common electrodes") for applying voltage across the pixel electrodes are provided. By the pixel electrode and the common electrode, a liquid crystal capacitance is formed. In such a liquid crystal display device, to sequentially select the gate bus line one-horizontal-scanning-period by one-horizontal-scanning-period, application to each gate bus line of an active scanning signal is repeated using one vertical scanning period as a cycle. Consequently, charges accumulated in each liquid crystal capacitance have to be held for approximately one vertical scanning period. However, the accumulated charges cannot be held only by the liquid crystal capacitance, so that auxiliary capacitance is provided in parallel with the liquid crystal capacitance. Note that, a group of components for forming one pixel including the above-described TFT, pixel electrode, common electrode, and liquid crystal layer will be referred to as a "pixel formation portion" in the following description. A group of pixel formation portions disposed in a matrix will be referred to as a "pixel matrix".

In such a configuration, by applying a voltage corresponding to the value of a pixel corresponding to a pixel electrode, between the pixel electrode and the common electrode, and changing the transmittance of the liquid crystal layer in accordance with the voltage application, an image is displayed on the liquid crystal panel. On this occasion, to prevent deterioration in a liquid crystal material constructing the liquid crystal layer, the liquid crystal panel is AC driven. Specifically, a video signal (a drive video signal) is applied to a source-bus line so that the polarity (positive/negative) of the voltage applied between each pixel electrode and the common electrode is inverted, for example, frame by frame.

Generally, in an active matrix-type liquid crystal panel, since the characteristics of a switching element such as a TFT or the like provided for each pixel are insufficient, even when the positive and negative polarities of a drive video signal applied to a source bus line (application voltage using the potential of the common electrode as a reference) are symmetrical, the transmittance of the liquid crystal layer for positive data voltage and that for negative data voltage are not perfectly symmetrical. Consequently, in the driving method (frame inversion driving method) for inverting the positive/negative polarity of a voltage applied to the liquid crystal frame by frame, flicker occurs in display in a liquid crystal panel.

As a countermeasure against the flicker as described above, a driving method (line inversion driving method) for inverting the positive/negative polarity frame by frame while inverting the positive/negative polarity of an application voltage every horizontal scanning period is known. FIG. 37 is a plan view showing the configuration of a part of a general display unit in a liquid crystal display device employing the line inversion driving method. FIG. 38 is an equivalent circuit diagram showing the configuration of a part of the display unit in the liquid crystal display device. As shown in FIGS. 37 and 38, pixel formation portions each including a TFT, a pixel electrode, and the like are provided in correspondence with crossing points between gate bus lines Gn, G(n+1), G(n+2), . . . and source bus lines Sm, S(m+1), S(m+2), . . . . The auxiliary capacitance electrode (auxiliary capacitance line) Cs for forming auxiliary capacitance is provided as shown in FIGS. 37 and 38.

In the configuration as described above, a signal waveform chart in the liquid crystal display device employing the line inversion driving method is as shown in FIG. 39. As shown in FIG. 39, in each horizontal scanning period, all of the polarities of drive video signals applied to the source bus lines are the same. Moreover, the polarity of the drive video signal is inverted every horizontal scanning period. Further, the polarity of the drive video signal is inverted also frame by frame. Consequently, a polarity diagram (a diagram showing polarities of voltages (pixel voltages) applied to the liquid crystals in the pixel formation portions) in two frame periods is as shown in FIG. 40.

However, according to the line inversion driving method, suppression of flicker is insufficient. Consequently, a driving method (dot inversion driving method) of inverting the polarity of the pixel voltage by frame period and also inverting the polarities of pixels neighboring in the vertical (perpendicular) direction and the polarities of pixels neighboring in the lateral (horizontal) direction in one frame period is often employed. The signal waveform chart in the liquid crystal display device employing the dot inversion driving method is as shown in FIG. 41. Consequently, a polarity diagram in the 2-frame period is as shown in FIG. 42. As shown in FIG. 42, the polarities of the pixels neighboring in the vertical and horizontal directions become opposite to each other, so that flicker is effectively suppressed more than that in the line inversion driving method.

In FIGS. 39 and 41, attention is paid to changes in the potential Com of the common electrode. As shown in FIG. 39, in the line inversion driving method, the potential Com of the common electrode is inverted every horizontal scanning period (such a method is referred to as "opposite AC driving"). On the other hand, as shown in FIG. 41, in the dot inversion driving method, the potential Com of the common electrode is constant (such a method is referred to as "opposite DC driving"). When the opposite AC driving and the opposite DC driving are compared, the amplitude of the drive video signal in the opposite DC driving has to be made larger. Consequently, in the case of employing the opposite DC driving, a source driver having a large withstand voltage is required and power consumption becomes large. Note that, the potential Cs of the auxiliary capacitance electrode also changes like the potential Com of the common electrode in both of the line inversion driving method and the dot inversion driving method.

According to the invention of the liquid crystal display device disclosed in Japanese Unexamined Patent Publication No. 04-360127, an array of pixels is as shown in FIGS. 43 and 44. In the liquid crystal display device, two gate bus lines are provided so as to sandwich, from the upper and lower sides, the pixel formation portions included in each of rows of the pixel matrix. Two pixel formation portions are provided in a region surrounded by two source bus lines which are neighboring and two gate bus lines disposed on the upper and lower sides of each row. In the pixel formation portion disposed on the left side out of the two pixel formation portions, the source terminal of a TFT is connected to the source bus line disposed on the left side out of the two source bus lines, and the gate terminal of the TFT is connected to the gate bus line disposed on the upper side out of the two gate bus lines. On the other hand, in the pixel formation portion disposed on the right side out of the two pixel formation portions, the source terminal of a TFT is connected to the source bus line disposed on the right side of the two source bus lines, and the gate terminal of the TFT is connected to the gate bus line disposed on the lower side out of the two gate bus lines.

In the configuration as described above, when signals are outputted as shown in FIG. 45, the polarity diagram in two frame periods is as shown in FIG. 46. Specifically, display similar to that in the frame inversion driving method is performed. Moreover, when signals are outputted as shown in FIG. 47, the polarity diagram in two frame periods is as shown in FIG. 48. Specifically, in one frame period, display is performed in which the polarities of pixels neighboring in the lateral direction are opposite to each other. Further, when signals are outputted as shown in FIG. 49, display similar to that in the line inversion driving method is performed as shown in FIG. 40. Further, when signals are outputted as shown in FIG. 50, display similar to that in the dot inversion driving method is performed as shown in FIG. 42.

In the configuration disclosed in Japanese Unexamined Patent Publication No. 04-360127, although the number of gate bus lines is twice as many as that in the conventional general configuration as described above, the number of source bus lines is the half. Since the source driver is generally more expensive than the gate driver, the cost is reduced with this configuration.

According to the invention of the liquid crystal display device disclosed in Japanese Patent Publication No. 3504496, an array of pixels is as shown in FIG. 51. In the liquid crystal display device, the positional relation (connection relation) of a TFT included in each of the pixel formation portions, a source bus line, and a gate bus line vary among regions expressed by reference numerals Ga1 to Ga4 in FIG. 51. In such a configuration, the waveforms of signals in predetermined successive periods are as shown in FIGS. 52 and 53. In the period shown in FIG. 52, an active scanning signal is supplied only to the gate bus line disposed on the upper side of each row. In the period shown in FIG. 53, the active scanning signal is supplied only to the gate bus line disposed on the lower side of each row. In other words, in this configuration, interlace driving is performed. Note that, Japanese Patent Publication No. 3091300 also discloses an invention of a liquid crystal display device in which an array of pixels is different from the conventional general configuration.

[Patent Document 1] Japanese Unexamined Patent Publication No. 04-360127

[Patent Document 2] Japanese Patent Publication No. 3504496

[Patent Document 3] Japanese Patent Publication No. 3091300

DISCLOSURE OF THE INVENTION

Problems to be Solved by the Invention

As described above, when the dot inversion driving method is employed, flicker is suppressed effectively. However, in the case of employing the dot inversion driving method, in each horizontal scanning period, a source bus line to which a drive video signal of the positive polarity is to be applied and a source bus line to which a drive video signal of the negative polarity is to be applied exist. Consequently, as the method of driving the common electrode, the opposite DC driving has to be employed. Therefore, as compared with the line inversion driving method, a source driver having a larger withstand voltage is required, and power consumption increases. This is similarly applied to the liquid crystal display device disclosed in Japanese Unexamined Patent Publication No. 04-360127 and the liquid crystal display device disclosed in the Japanese Patent Publication No. 3504496.

Therefore, an object of the present invention is to provide a display device in which occurrence of flicker can be suppressed without increasing power consumption.

Means for Solving the Problems

A first aspect of the present invention relates to a display device having color filters formed by at least three primary colors, including:

a plurality of video signal lines for transmitting a video signal representing an image to be displayed;

a plurality of scanning signal lines crossing the plurality of video signal lines;

a video signal line drive circuit for applying the video signal to the plurality of video signal lines;

a scanning signal line drive circuit for selectively driving the plurality of scanning signal lines every horizontal scanning period;

a plurality of pixel formation portions disposed in a matrix using an extension direction of the plurality of video signal lines as a column direction and using an extension direction of the plurality of scanning signal lines as a row direction; and a display unit including the plurality of video signal lines, the plurality of scanning signal lines, and the plurality of pixel formation portions, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines, and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines, and the video signal line drive circuit makes all of polarities of video signals applied to each video signal line the same polarity in each horizontal scanning period and makes the polarity of a video signal applied to each video signal line vary between the case where a scanning signal line disposed on the upper side of any of the rows constructing the matrix is selected and the case where a scanning signal line disposed on the lower side of any of the rows constructing the matrix is selected in each vertical scanning period.

According to a second aspect of the present invention, in the first aspect of the present invention, the pixel formation portion pair of the first type and the pixel formation portion pair of the second type are repeated alternately in the extension direction of the plurality of video signal lines, and the scanning signal line drive circuit sequentially and selectively drives the plurality of scanning signal lines one by one.

According to a third aspect of the present invention, in the first aspect of the present invention, the pixel formation portion pair of the first type and the pixel formation portion pair of the second type are repeated twice alternately in the extension direction of the plurality of video signal lines, and the scanning signal line drive circuit selectively drives two each of scanning signal lines in the plurality of scanning signal lines while skipping two scanning signal lines.

According to a fourth aspect of the present invention, in the first aspect of the present invention, the display device further includes a common electrode drive circuit for driving the common electrode so that the polarity of a voltage applied to the common electrode when a predetermined potential is set as a reference is inverted every horizontal scanning period, wherein the video signal line drive circuit applies the video signal to the plurality of video signal lines so that the polarity of the video signal when the potential of the common electrode is set as a reference is inverted every horizontal scanning period.

A fifth aspect of the present invention relates to a display panel having a color filter formed by at least three primary colors, including: a plurality of video signal lines for transmitting a video signal representing an image to be displayed;

a plurality of scanning signal lines crossing the plurality of video signal lines; and a plurality of pixel formation portions disposed in a matrix using an extension direction of the plurality of video signal lines as a column direction and using an extension direction of the plurality of scanning signal lines as a row direction, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines; and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, and the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines.

A sixth aspect of the present invention relates to a method of driving a display device having color filters formed by at least three primary colors, a plurality of video signal lines for transmitting a video signal representing an image to be displayed, a plurality of scanning signal lines crossing the plurality of video signal lines, a plurality of pixel formation portions disposed in a matrix using an extension direction of the plurality of video signal lines as a column direction and using an extension direction of the plurality of scanning signal lines as a row direction, and a display unit including the plurality of video signal lines, the plurality of scanning signal lines, and the plurality of pixel formation portions, including:

a video signal line driving step of applying the video signal to the plurality of video signal lines; and a scanning signal line driving step of selectively driving the plurality of scanning signal lines every horizontal scanning period, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines; and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines, and in the video signal line driving step, all of polarities of video signals applied to each video signal line are made the same polarity in each horizontal scanning period and the polarity of a video signal applied to each video signal line is made vary between the case where a scanning signal line disposed on the upper side of any of the rows constructing the matrix is selected and the case where a scanning signal line disposed on the lower side of any of the rows constructing the matrix is selected in each vertical scanning period.

Also, variants grasped by referring to embodiments and the drawings in the sixth aspect of the present invention are considered to be means for solving the problem.

Effects of the Invention

According to the first aspect of the present invention, the pixel formation portion pair of the first type and the pixel formation portion pair of the second type are repeated alternately in the extension direction of the video signal lines, and the pixel formation portion pair of the first type and the pixel formation portion pair of the second type are repeated in the extension direction of the scanning signal lines. Moreover, all of the polarities of video signals applied to each video signal line in each horizontal scanning period are set to be the same, and the polarity of a video signal applied to each video signal line is made vary between the case where a scanning signal line disposed on the upper side of any of the rows is selected and the case where a scanning signal line disposed on the lower side of any of the rows is selected. In such a manner, the polarities of the pixel voltages between the pixel formation portions neighboring in the horizontal direction and between the pixel formation portions neighboring in the vertical direction become opposite, thus the dot inversion driving is performed. Consequently, occurrence of flicker is suppressed. Moreover, while the pixel formation portion pair of the first type or the pixel formation portion pair of the second type is repeated in the extension direction of the scanning signal line, one video signal line is shared by the pixel formation portions disposed on both sides of the video signal line. Therefore, the number of video signal lines is smaller than that in the conventional configuration. Thus, occurrence of flicker is suppressed at low cost.

According to the second aspect of the present invention, in the display device in which the scan is performed sequentially, in a manner similar to the first aspect, occurrence of flicker can be suppressed while reducing the cost.

According to the third aspect of the present invention, in the display device in which the interlace driving is performed, in a manner similar to the first aspect, occurrence of flicker can be suppressed while reducing the cost.

According to the fourth aspect of the present invention, the common electrode driving method is the opposite AC driving. Consequently, the amplitude of a video signal to be applied to the video signal line can be made small. Therefore, the power consumption can be reduced. Moreover, since a video signal line drive circuit using a relatively low withstand voltage can be employed, the cost can be reduced.

BRIEF DESCRIPTION OF THE DRAWINGS

FIG. 10 is a diagram (polarity diagram) showing polarities of sub-pixels in the odd-numbered fields in the first embodiment.

FIG. 11 is a diagram (polarity diagram) showing polarities of sub-pixels in the even-numbered fields in the first embodiment.

FIG. 15 is a diagram (polarity diagram) showing polarities of sub-pixels in odd-numbered fields in the modification.

FIG. 16 is a diagram (polarity diagram) showing polarities of sub-pixels in even-numbered fields in the modification.

FIG. 23 is a diagram (polarity diagram) showing polarities of sub-pixels in the first field of the odd-numbered frame in the second embodiment.

FIG. 24 is a diagram (polarity diagram) showing polarities of sub-pixels in the second field of the odd-numbered frame in the second embodiment.

FIG. 25 is a diagram (polarity diagram) showing polarities of sub-pixels in the first field of the even-numbered frame in the second embodiment.

FIG. 26 is a diagram (polarity diagram) showing polarities of sub-pixels in the second field of the even-numbered frame in the second embodiment.

FIG. 29 is a diagram (polarity diagram) showing polarities of sub-pixels in an odd-numbered frame in the third embodiment.

FIG. 30 is a diagram (polarity diagram) showing polarities of sub-pixels in an even-numbered frame in the third embodiment.

FIG. 32 is a diagram (polarity diagram) showing polarities of sub-pixels in an odd-numbered frame in the first modification.

FIG. 33 is a diagram (polarity diagram) showing polarities of sub-pixels in an even-numbered frame in the first modification.

FIG. 35 is a diagram (polarity diagram) showing polarities of sub-pixels in an odd-numbered frame in the second modification.

FIG. 36 is a diagram (polarity diagram) showing polarities of sub-pixels in an even-numbered frame in the second modification.

DESCRIPTION OF REFERENCE NUMERALS

Figure 1:
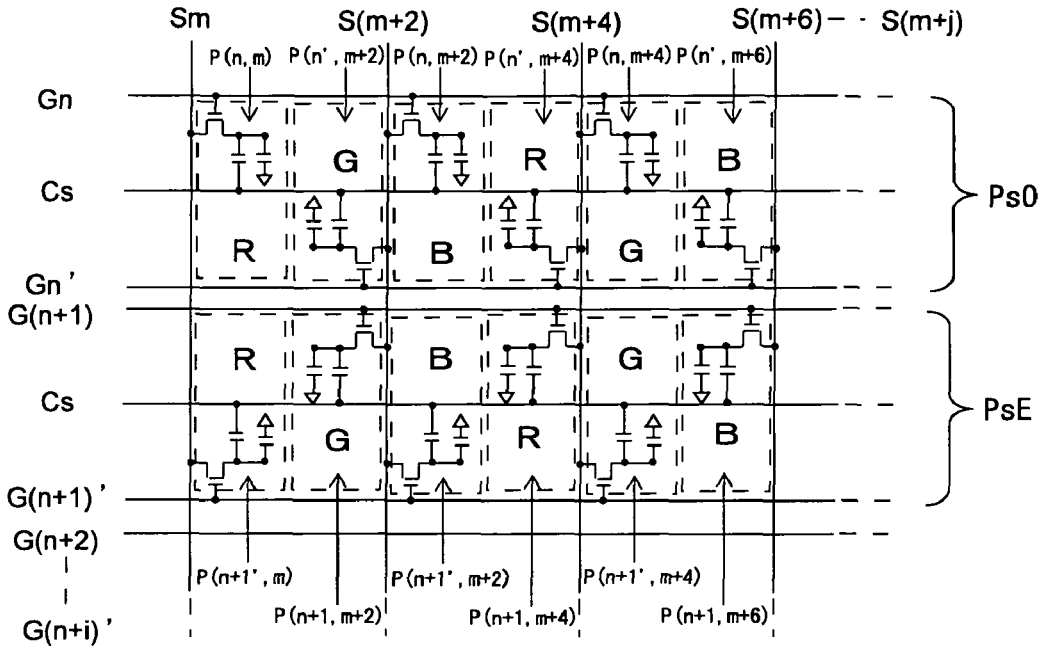
FIG. 1 is an equivalent circuit diagram showing the configuration of a part of a display unit in a liquid crystal display device according to a first embodiment of the invention.

10 . . . TFT
11 . . . pixel electrode
100 . . . display unit
200 . . . display control circuit
210 . . . display memory

220 . . . timing control circuit
230 . . . W pixel data computing circuit
300 . . . source driver (video signal line drive circuit)
400 . . . gate driver (scanning signal line drive circuit)
500 . . . power supply circuit
Cs . . . auxiliary capacitance line
Gn, Gn', G(n+1), G(n+1)' . . . gate bus lines, scanning signals
Sm, S(m+2), S(m+4) . . . source bus line, drive video signals

BEST MODE FOR CARRYING OUT THE INVENTION

Embodiments of the present invention will be described below with reference to the accompanying drawings.

1. First Embodiment

1.1 General Configuration and Operation

Figure 2:
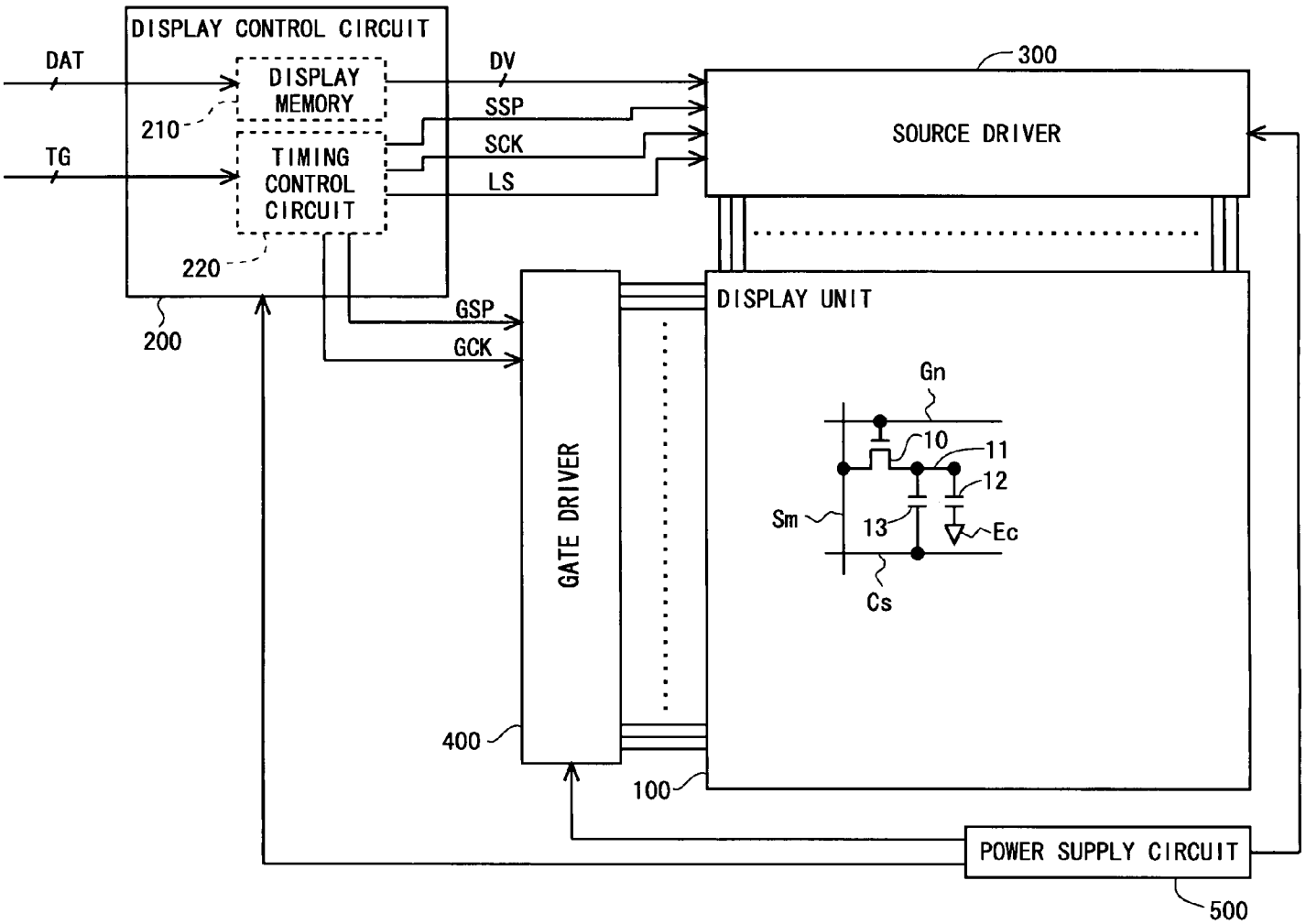
FIG. 2 is a block diagram showing a general configuration of the liquid crystal display device in the first embodiment.

FIG. 2 is a block diagram showing a general configuration of a liquid crystal display device according to a first embodiment of the present invention. The liquid crystal display device has a display unit 100, a display control circuit 200, a source driver (video signal line drive circuit) 300, a gate driver (scanning signal line drive circuit) 400, and a power supply circuit 500. The display control circuit 200 includes a display memory 210 and a timing control circuit 220. Note that, the liquid crystal display device will be described on assumption that it is of the QVGA type.

The display unit 100 includes a plurality of source bus lines (video signal lines), a plurality of gate bus lines (scanning signal lines), and a plurality of pixel formation portions. The plurality of pixel formation portions are classified into an R pixel formation portion for forming a pixel (sub-pixel) of red, a G pixel formation portion for forming a pixel (sub-pixel) of green, and a B pixel formation portion for forming a pixel (sub-pixel) of blue by color filters. One pixel in an image displayed on the display unit 100 is formed by the pixel of red, the pixel of green, and the pixel of blue. Note that, in the following description, each of the R pixel formation portion, the G pixel formation portion, and the B pixel formation portion will be also simply referred to as a "sub-pixel". A group of the pixel formation portions formed by the R pixel formation portion, the G pixel formation portion, and the B pixel formation portion will be also simply referred to as a "pixel".

Each pixel formation portion (each sub pixel) includes a TFT 10 as a switching element, a pixel electrode 11 connected to the drain terminal of the TFT 10, a common electrode Ec and an auxiliary capacitance electrode Cs which are commonly provided for the plurality of pixel formation portions, a liquid crystal capacitance 12 formed by the pixel electrode 11 and the common electrode Ec, and an auxiliary capacitance 13 formed by the pixel electrode 11 and the auxiliary capacitance electrode Cs. By the liquid crystal capacitance 12 and the auxiliary capacitance 13, a pixel capacitance is formed. Note that, the positional relations (connection relations) among the TFT included in each pixel formation portion, the source bus line, and the gate bus line will be described in detail later.

The display control circuit 200 receives image data DAT transmitted from the outside and a timing signal group TG including a sync signal, a clock signal and so on. The image data DAT is temporarily stored in the display memory 210. The timing signal group TG is given to the timing control circuit 220. The image data DAT temporarily stored in the display memory 210 is outputted as a digital video signal DV indicative of a tone value of each sub-pixel. Based on the timing signal group TG, the timing control circuit 220 outputs a source start pulse signal SSP, a source clock signal SCK, a latch strobe signal LS, a gate start pulse signal GSP, and a gate clock signal GCK which are for controlling a timing of displaying an image on the display unit 100.

The source driver 300 receives the digital video signal DV, the source start pulse signal SSP, the source clock signal SCK, and the latch strobe signal LS which are outputted from the display control circuit 200, and applies a drive video signal for charging the pixel capacitance of each pixel formation portion in the display unit 100 to each source bus line. The gate driver 400 applies an active scanning signal to each gate bus line based on the gate start pulse signal GSP and the gate clock signal GCK which are outputted from the display control circuit 200. The power supply circuit 500 applies a predetermined power supply voltage to the display control circuit 200, the source driver 300, and the gate driver 400. The detailed configuration of the source driver 300 will be described later.

By applying the drive video signals to the source bus lines and applying the scanning signals to the gate bus lines as described above, an image is displayed on the display unit 100.

1.2 Array of Pixels

Figure 3:
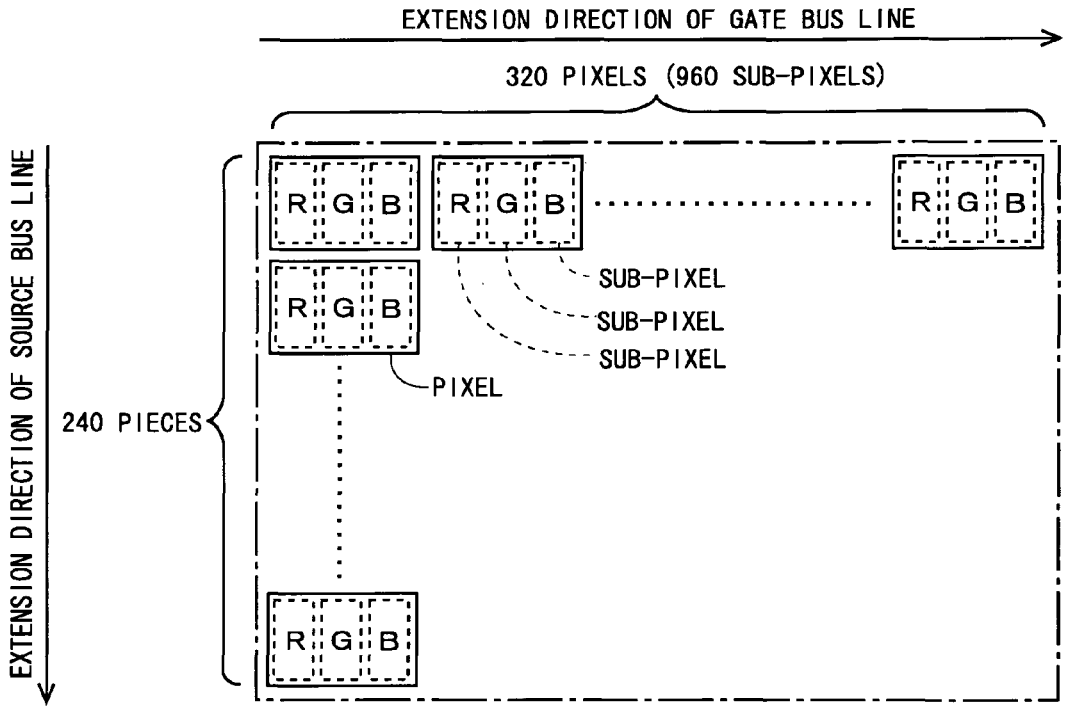
FIG. 3 is a plan view for explaining an array of pixels in the first embodiment.

An array of pixels in the embodiment will now be described. FIG. 3 is a plan view for explaining an array of pixels. In the embodiment, to display a color image, a single pixel is formed by a sub-pixel of red (R), a sub-pixel of green (G), and a sub-pixel of blue (B) as shown in FIG. 3. In the extension direction of the gate bus line, 320 pixels, that is, 960 sub-pixels are formed. In the extension direction of the source bus line, 240 pixels (sub-pixels) are formed. In such a manner, a pixel matrix of 240 rows×960 columns is formed.

Figure 4:
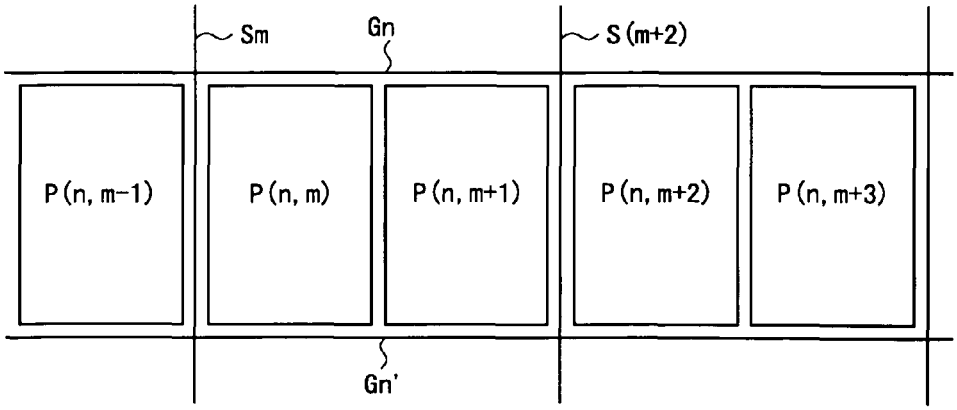
FIG. 4 is a diagram for explaining a way of designating reference numerals in the first embodiment.
Figure 8:
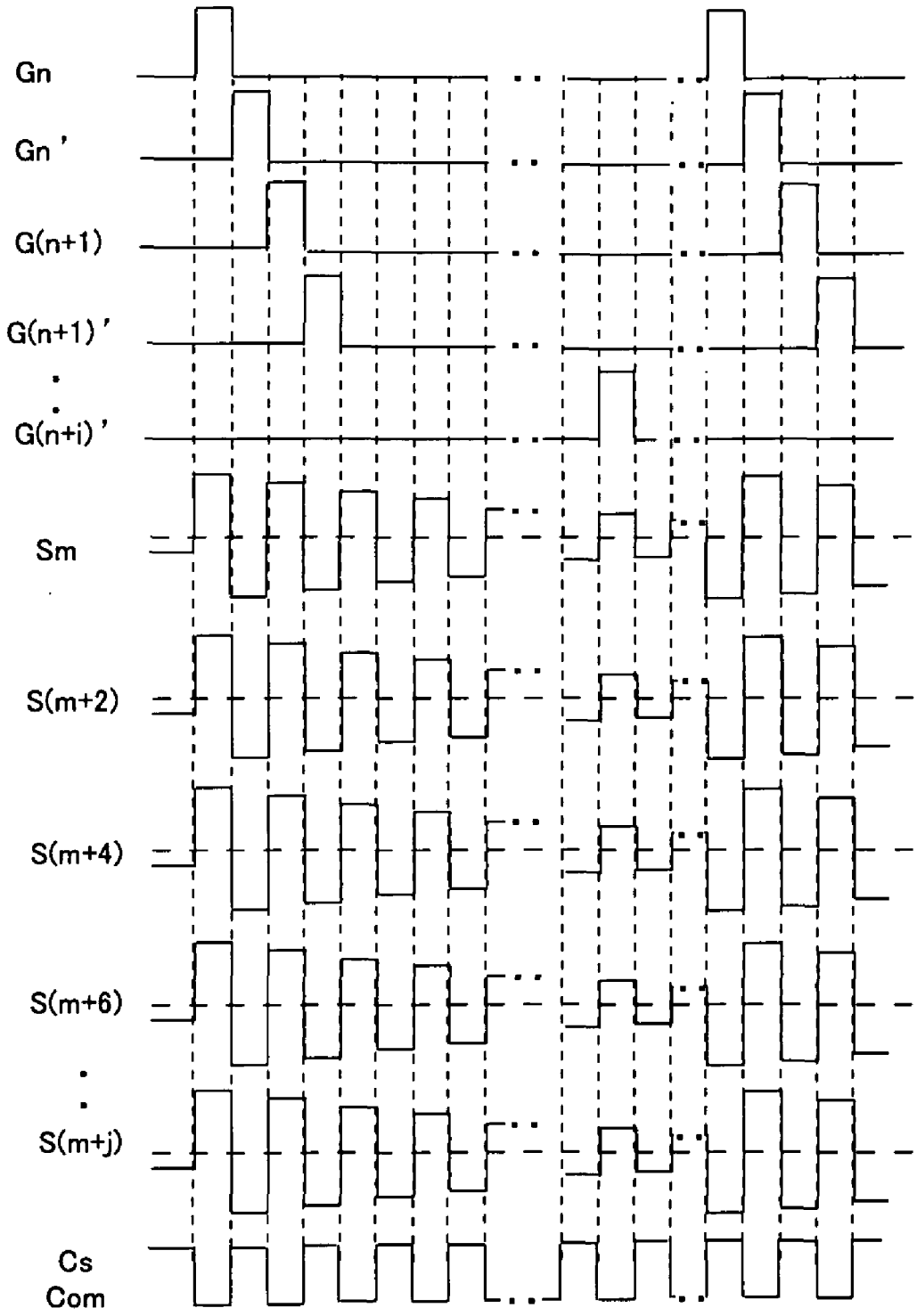
FIG. 8 is a signal waveform chart for explaining a driving method in an odd-numbered field in the first embodiment.

Referring to FIG. 4, a way of designating reference numerals in the following will be described. To the sub-pixel disposed in the n-th order (n-th row) from the top in the extension direction of the source bus line and in the m-th order (m-th column) from the left in the extension direction of the gate bus line in the pixel matrix shown in FIG. 3, reference numeral P (n, m) is designated as shown in FIG. 4. To a gate bus line disposed on the upper side out of two gate bus lines disposed so as to sandwich the sub-pixels disposed in the n-th row from the upper and lower sides, reference numeral Gn is designated, and to the gate bus line disposed on the lower side, reference numeral Gn' is designated. To a source bus line disposed between the sub-pixels disposed in the m-th column and the sub-pixels disposed in the (m−1)th column, reference numeral Sm is designated. Note that, the reference numeral Gn is used also to express a scanning signal supplied to the gate bus line designated with the reference numeral Gn, and the reference numeral Sm is used also to express a drive video signal supplied to the source bus line designated with the reference numeral Sm (FIG. 8 and the like). Moreover, a group of pixels (a group of sub-pixels) disposed linearly in the extension direction of the gate bus lines will be also referred to as a "row", and a group of pixels (a group of sub-pixels) disposed linearly in an arbitrary k-th row will be also simply referred to as the "k-th row". Further, a group of pixels (a group of sub-pixels) disposed linearly in the extension direction of the source bus line will be also referred to as a "column".

Figure 5:
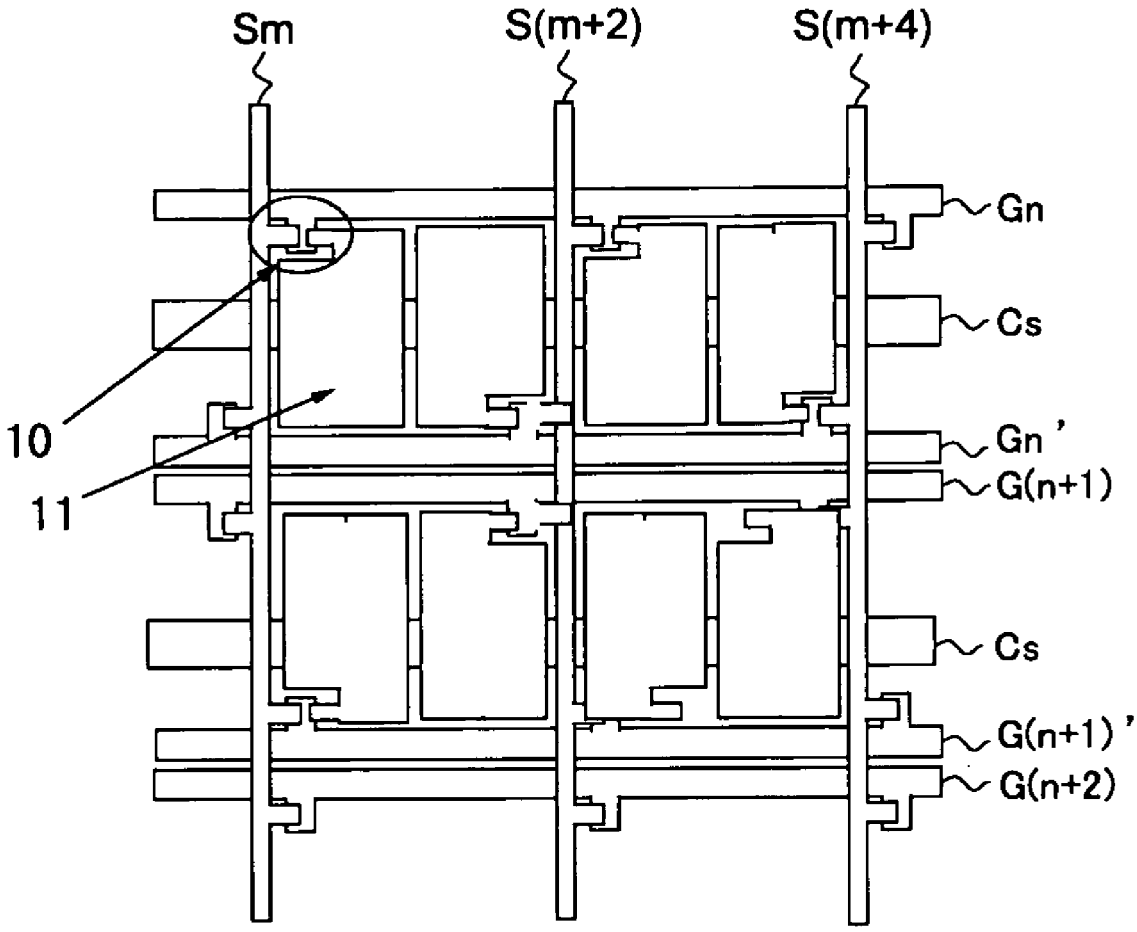
FIG. 5 is a plan view showing the configuration of a part of the display unit in the first embodiment.

FIG. 1 is an equivalent circuit diagram showing the configuration of a part of the display unit 100. FIG. 5 is a plan view showing the configuration of a part of the display unit 100. As shown in FIGS. 1 and 5, two gate bus lines are provided for each row so as to sandwich the sub-pixels disposed in the row from the upper and lower sides. As shown in FIG. 3, since 240 pixels (sub-pixels) are formed in the extension direction of a source bus line, 480 gate bus lines are provided in the display unit 100. As shown in FIGS. 1 and 5, one source bus line is provided per two columns. As shown in FIG. 3, since 320 pixels, that is, 960 sub-pixels are formed in the extension direction of the gate bus line, 480 source bus lines are provided in the display unit 100.

As shown in FIGS. 1 and 5, two sub-pixels are formed in a region surrounded by two neighboring source bus lines and two gate bus lines provided on both upper and lower sides of each row. The positional relations (connection relations) among the two sub-pixels, the source bus lines, and the gate bus lines in an odd-numbered row PsO and those in an even-numbered row PsE are different from each other.

First, attention is paid to the odd-numbered row PsO. With respect to the sub-pixel disposed on the left side out of the two sub-pixels, the source terminal of the TFT 10 is connected to the source bus line disposed on the left side out of the two source bus lines, and the gate terminal of the TFT 10 is connected to the gate bus line disposed on the upper side out of the two gate bus lines. On the other hand, with respect to the sub-pixel disposed on the right side, the source terminal of the TFT 10 is connected to the source bus line disposed on the right side, and the gate terminal of the TFT 10 is connected to the gate bus line disposed on the lower side. In the embodiment, by the configuration of the odd-numbered row PsO, a pixel formation portion pair of a first type is realized.

For example, in FIG. 1, attention is paid to two sub-pixels P(n, m) and P(n', m+2) surrounded by two gate bus lines represented by the reference numerals Gn and Gn' and two source bus lines represented by the reference numerals Sm and S(m+2). With respect to the sub-pixel P(n, m) disposed on the left side out of the two sub-pixels, the source terminal of the TFT 10 is connected to the source bus line Sm, and the gate terminal of the TFT 10 is connected to the gate bus line Gn. Therefore, to the sub-pixel P(n, m), a scanning signal is supplied from the gate bus line Gn, and a drive video signal is supplied from the source bus line Sm. On the other hand, with respect to the sub-pixel P(n', m+2) disposed on the right side, the source terminal of the TFT 10 is connected to the source bus line S(m+2), and the gate terminal of the TFT 10 is connected to the gate bus line Gn'. Therefore, to the sub-pixel P(n', m+2), a scanning signal is supplied from the gate bus line Gn', and a drive video signal is supplied from the source bus line S(m+2).

Next, attention is paid to the even-numbered row PsE. With respect to the sub-pixel disposed on the left side out of the two sub-pixels, the source terminal of the TFT 10 is connected to the source bus line disposed on the left side out of the two source bus lines, and the gate terminal of the TFT 10 is connected to the gate bus line disposed on the lower side out of the two gate bus lines. On the other hand, with respect to the sub-pixel disposed on the right side, the source terminal of the TFT 10 is connected to the source bus line disposed on the right side, and the gate terminal of the TFT 10 is connected to the gate bus line disposed on the upper side. In the embodiment, by the configuration of the even-numbered row PsE, a pixel formation portion pair of a second type is realized.

For example, in FIG. 1, attention is paid to two sub-pixels P(n+1', m) and P(n+l, m+2) surrounded by two gate bus lines represented by the reference numerals G(n+1) and G (n+1)' and two source bus lines represented by the reference numerals Sm and S(m+2). With respect to the sub-pixel P(n+1', m) disposed on the left side out of the two sub-pixels, the source terminal of the TFT 10 is connected to the source bus line Sm, and the gate terminal of the TFT 10 is connected to the gate bus line G(n+1)'. Therefore, to the sub-pixel P(n+1', m), a scanning signal is supplied from the gate bus line G(n+1)', and a drive video signal is supplied from the source bus line Sm. On the other hand, with respect to the sub-pixel P(n+1, m+2) disposed on the right side, the source terminal of the TFT 10 is connected to the source bus line S(m+2), and the gate terminal of the TFT 10 is connected to the gate bus line G(n+1). Therefore, to the sub-pixel P(n+1, m+2), a scanning signal is supplied from the gate bus line G(n+1), and a drive video signal is supplied from the source bus line S(m+2).

Figure 6:
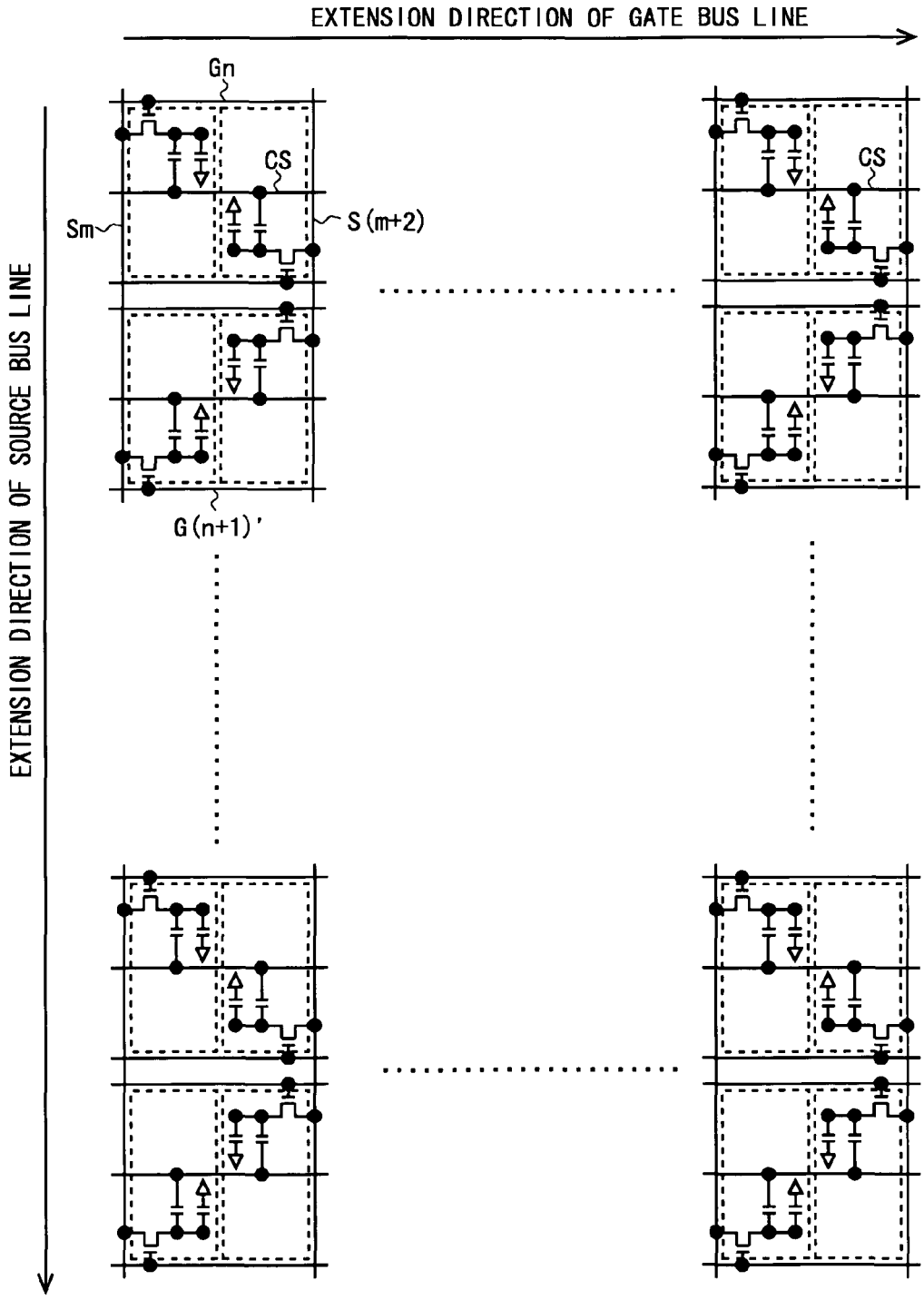
FIG. 6 is a plan view for explaining an array of pixels in the entire display unit in the first embodiment.

Now, when four sub-pixels surrounded by the two gate bus lines Gn and G(n+1)' and two source bus lines Sm and S(m+2) are used as a configuration unit as a collection, as shown in FIG. 6, a configuration similar to the configuration unit is repeated in the extension direction of the gate bus lines and the extension direction of the source bus lines.

1.3 Configuration and Operation of Source Driver

Figure 7:
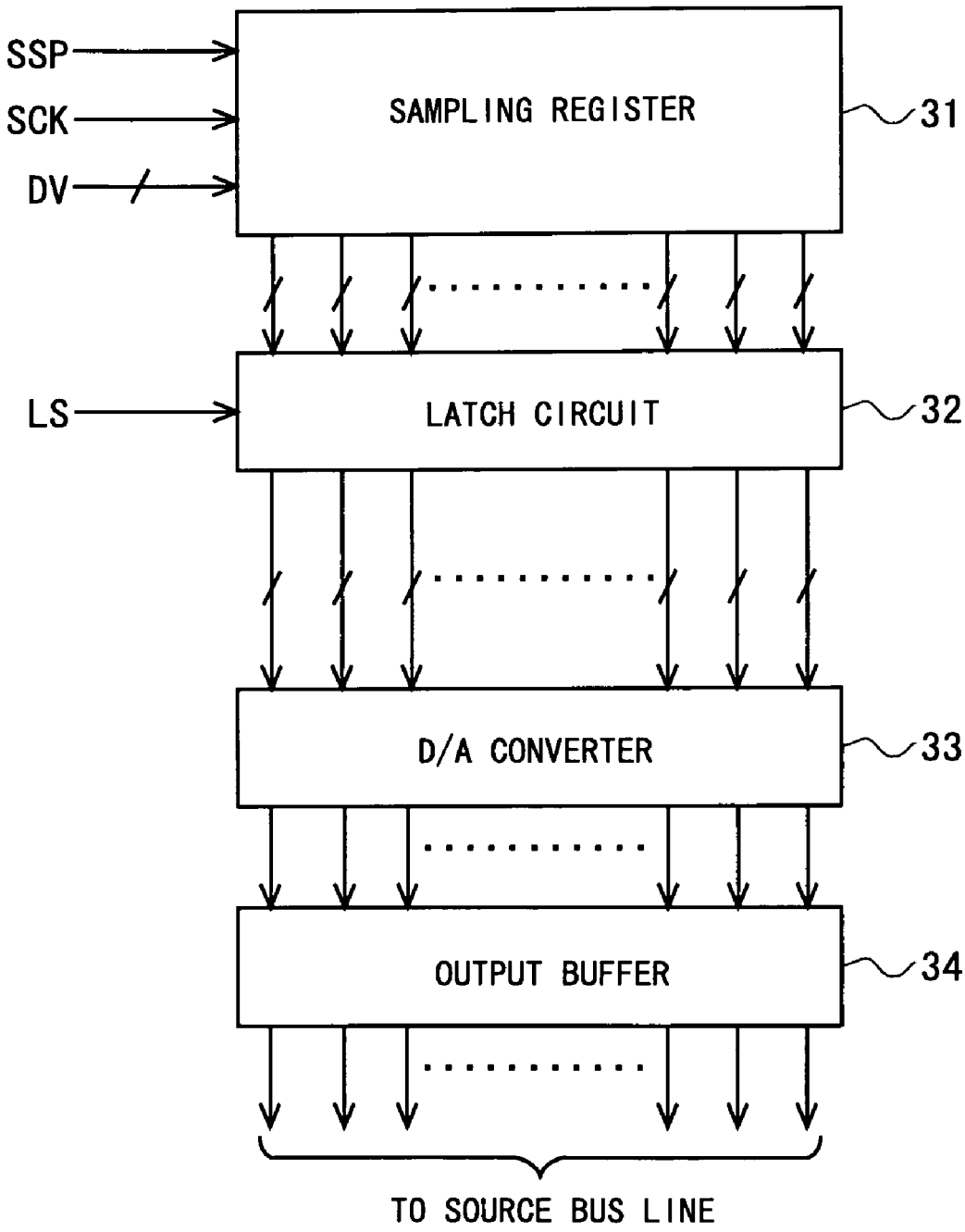
FIG. 7 is a block diagram showing the configuration of a source driver in the first embodiment.

FIG. 7 is a block diagram showing the configuration of the source driver 300 in the embodiment. The source driver 300 includes a sampling register 31 for sampling the digital video signal DV transmitted from the display control circuit 200, a latch circuit 32 for outputting internal image signals sampled by the sampling register 31 all at once, a D/A converter 33 for converting an internal image signal as a digital signal to an analog signal, and an output buffer 34 for applying the analog signal outputted from the D/A converter 33 as a drive video signal to a source bus line.

To the sampling register 31, the source start pulse signal SSP, the source clock signal SCK, and the digital video signal DV are inputted. Data sampled in the sampling register 31 is inputted as an internal image signal to the latch circuit 32.

The latch circuit 32 concurrently outputs the internal image signals outputted from the sampling register 31 at the timing of the pulse of the latch strobe signal LS outputted from the display control circuit 200. The D/A converter 33 performs digital-to-analog converting process on the internal image signals (as digital signals) outputted from the latch circuit 32 and outputs analog signals generated by the converting process.

The output buffer 34 performs impedance conversion by, for example, a voltage follower on the analog signals (voltage signals) outputted from the D/A converter 33 and outputs the converted voltages as drive video signals to the source bus line.

1.4 Driving Method

Figure 9:
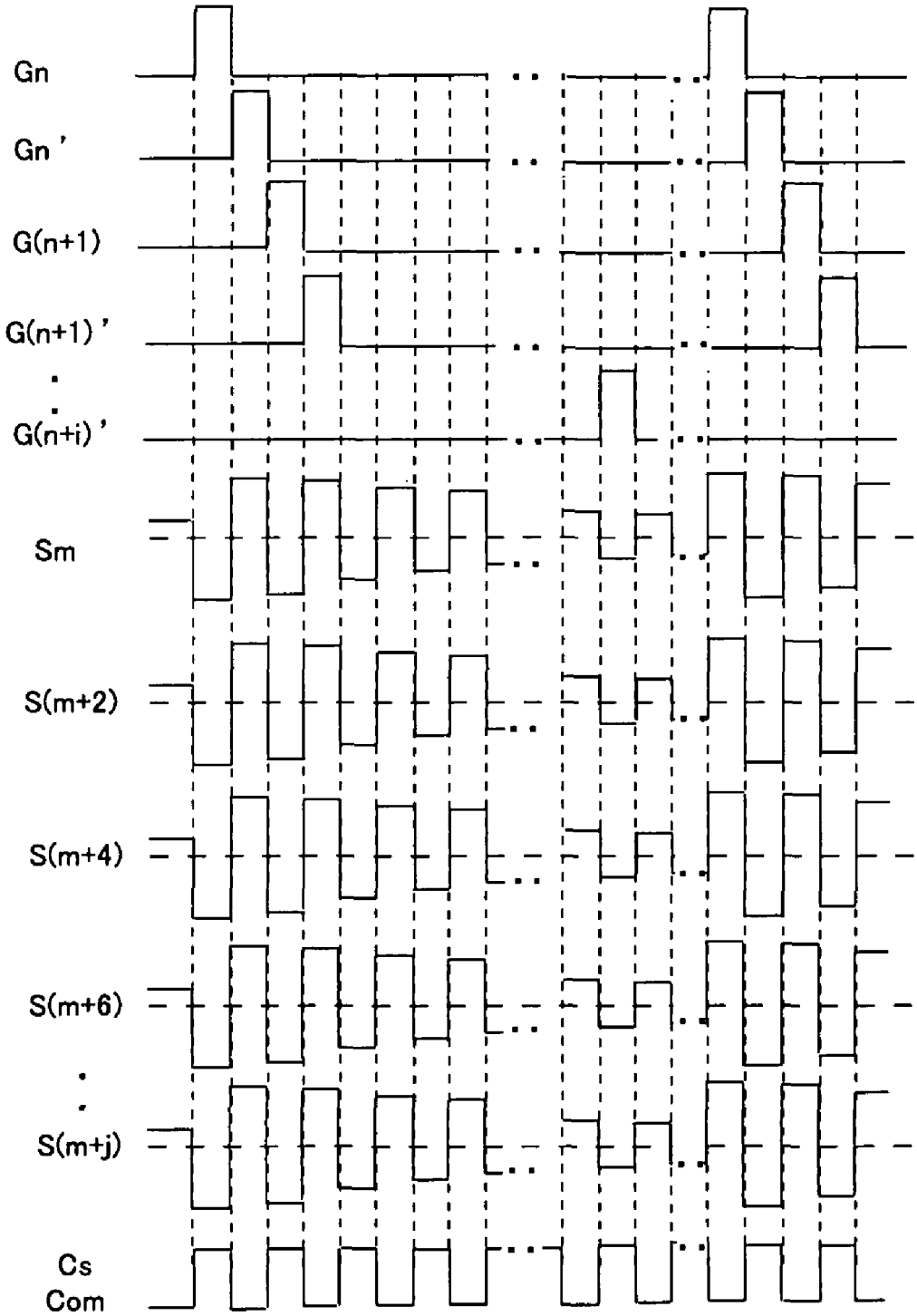
FIG. 9 is a signal waveform chart for explaining a driving method in an even-numbered field in the first embodiment.

Next, a driving method in the embodiment will be described. FIG. 8 is a signal waveform chart in an odd-numbered frame, and FIG. 9 is a signal waveform chart in an even-numbered frame. Note that, with respect to the waveforms of the drive video signals, it is assumed that a gradation display is performed in each frame period.

First, a driving method in an odd-numbered frame will be described with reference to FIG. 8. An active scanning signal is applied sequentially to gate bus lines one-horizontal-scanning-period by one-horizontal-scanning-period. When an active scanning signal is applied to the gate bus line Gn disposed on the upper side of the n-th row, all of the polarities of drive video signals applied to the source bus lines are positive. Accordingly, all of the polarities of sub-pixels which receive supply of the scanning signal from the gate bus line Gn become positive. Next, when the active scanning signal is applied to the gate bus line Gn' disposed on the lower side of the n-th row, all of the polarities of the drive video signals applied to the source bus lines are negative. Accordingly, all of the polarities of the sub-pixels which receive supply of the scanning signal from the gate bus line Gn' become negative. Further, when an active scanning signal is applied to the gate bus line G(n+1) disposed on the upper side of the (n+1)th row, all of the polarities of drive video signals applied to the source bus lines are positive. Accordingly, all of the polarities of sub-pixels which receive supply of the scanning signal from the gate bus line G(n+1) become positive. Further, when the active scanning signal is applied to the gate bus line G(n+1)' disposed on the lower side of the (n+1)th row, all of the polarities of the drive video signals applied to the source bus lines are negative. Accordingly, all of the polarities of the sub-pixels which receive supply of the scanning signal from the gate bus line G(n+1)' become negative. As described above, the horizontal scanning period in which all of the polarities of the drive video signals applied to the source bus lines are positive and the horizontal scanning period in which all of the polarities of the drive video signals applied to the source bus lines are negative appear alternately every horizontal scanning period. Note that, the polarity of the signal (auxiliary capacitance electrode drive signal) Cs for driving the auxiliary capacitance electrode and that of the signal (common electrode drive signal) Com for driving the common electrode are opposite to the polarities of all of drive video signals in each horizontal scanning period.

Next, with reference to FIG. 9, a driving method in an even-numbered frame will be described. In a manner similar to the odd-numbered frames, an active scanning signal is applied sequentially to gate bus lines one-horizontal-scanning-period by one-horizontal-scanning-period. When an active scanning signal is applied to the gate bus line Gn disposed on the upper side of the n-th row, all of the polarities of drive video signals applied to the source bus lines are negative. Accordingly, all of the polarities of sub-pixels which receive supply of the scanning signal from the gate bus line Gn become negative. Next, when the active scanning signal is applied to the gate bus line Gn' disposed on the lower side of the n-th row, all of the polarities of the drive video signals applied to the source bus lines are positive. Accordingly, all of the polarities of the sub-pixels which receive supply of the scanning signal from the gate bus line Gn' become positive. Further, when an active scanning signal is applied to the gate bus line G(n+1) disposed on the upper side of the (n+1)th row, all of the polarities of drive video signals applied to the source bus lines are negative. Accordingly, all of the polarities of sub-pixels which receive supply of the scanning signal from the gate bus line G(n+1) become negative. Further, when the active scanning signal is applied to the gate bus line G(n+1)' disposed on the lower side of the (n+1)th row, all of the polarities of the drive video signals applied to the source bus lines are positive. Accordingly, all of the polarities of the sub-pixels which receive supply of the scanning signal from the gate bus line G(n+1)' become positive. As described above, all of the polarities of the drive video signals in each horizontal scanning period are opposite to those in the odd-numbered frames. Note that, like in the odd-numbered frames, the polarities of the auxiliary capacitance electrode drive signal Cs and the common electrode drive signal Com are opposite to those of all of drive video signals in each horizontal scanning period.

1.5 Effect

According to the embodiment, as shown in FIG. 1, the positional relation (connection relation) between two sub-pixels, disposed between neighboring two source bus lines, and the gate bus lines and the source bus lines in the odd-numbered row PsO and that in the even-numbered row PsE are different from each other. Concretely, in the odd-numbered row PsO, with respect to the sub-pixel disposed on the left side out of the two sub-pixels, the scanning signal is supplied from the gate bus line disposed on the upper side of the sub-pixel, and with respect to the sub-pixel disposed on the right side, the scanning signal is supplied from the gate bus line disposed on the lower side of the sub-pixel. On the other hand, in the even-numbered row PsE, with respect to the sub-pixel disposed on the left side out of the two sub-pixels, the scanning signal is supplied from the gate bus line disposed on the lower side of the sub-pixel, and with respect to the sub-pixel disposed on the right side, the scanning signal is supplied from the gate bus line disposed on the upper side of the sub-pixel. As shown in FIGS. 8 and 9, all of the polarities of the drive video signals in each horizontal scanning period are the same, and all of the polarities of the drive video signals are inverted every horizontal scanning period. Consequently, in each frame period, the polarities of two sub-pixels which are neighboring in the horizontal direction are opposite to each other, and the polarities of two sub-pixels which are neighboring in the vertical direction are opposite to each other. Concretely, a polarity diagram in an odd-numbered frame is as shown in FIG. 10, and a polarity diagram in an even-numbered frame is as shown in FIG. 11. Thus, according to the embodiment, the dot inversion driving is performed. Consequently, occurrence of flicker is suppressed and excellent display quality is obtained.

Figure 37:
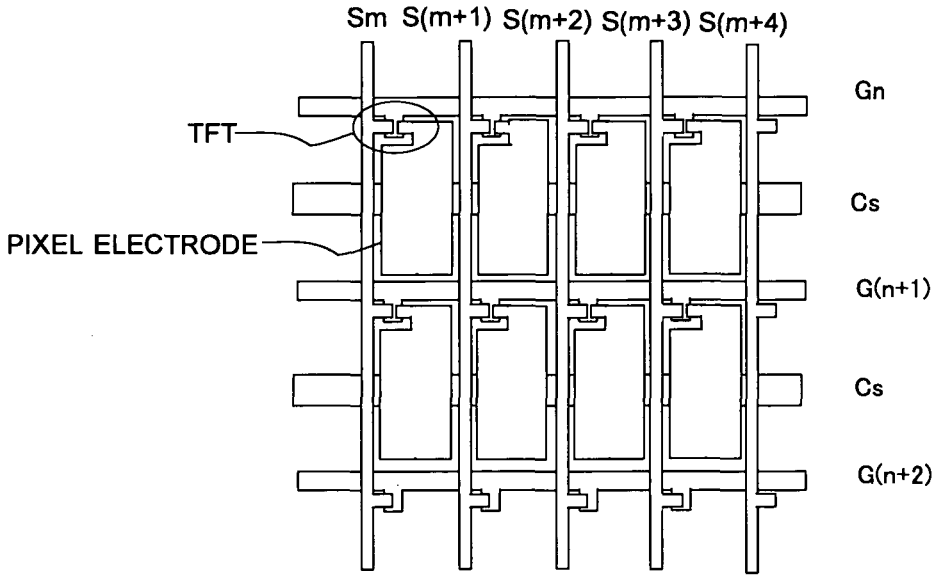
FIG. 37 is a plan view showing the configuration of a part of a general display unit in a conventional technique.
Figure 38:
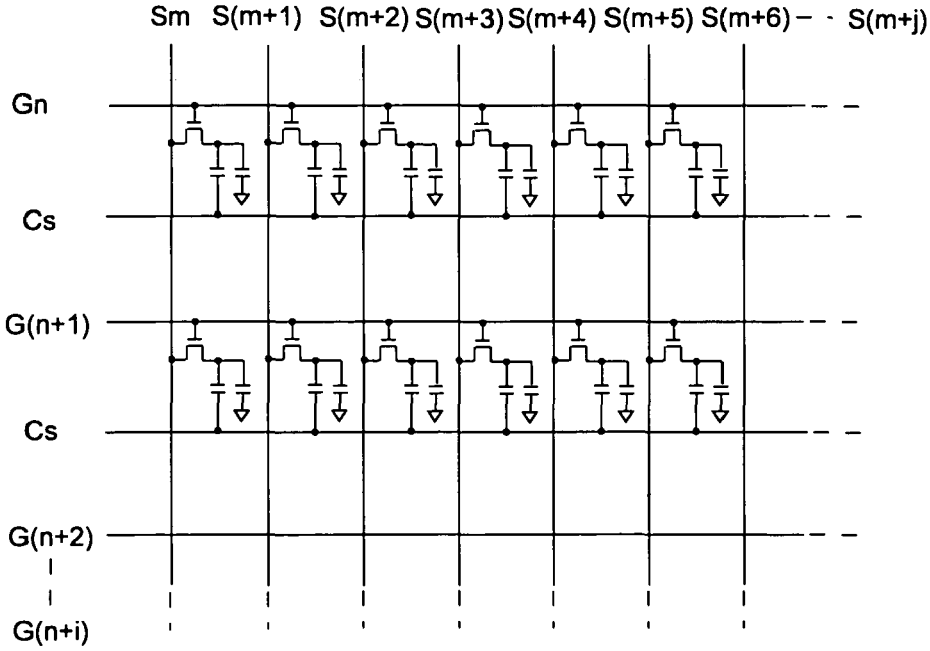
FIG. 38 is an equivalent circuit diagram showing the configuration of a part of the general display unit in the conventional technique.
Figure 39:
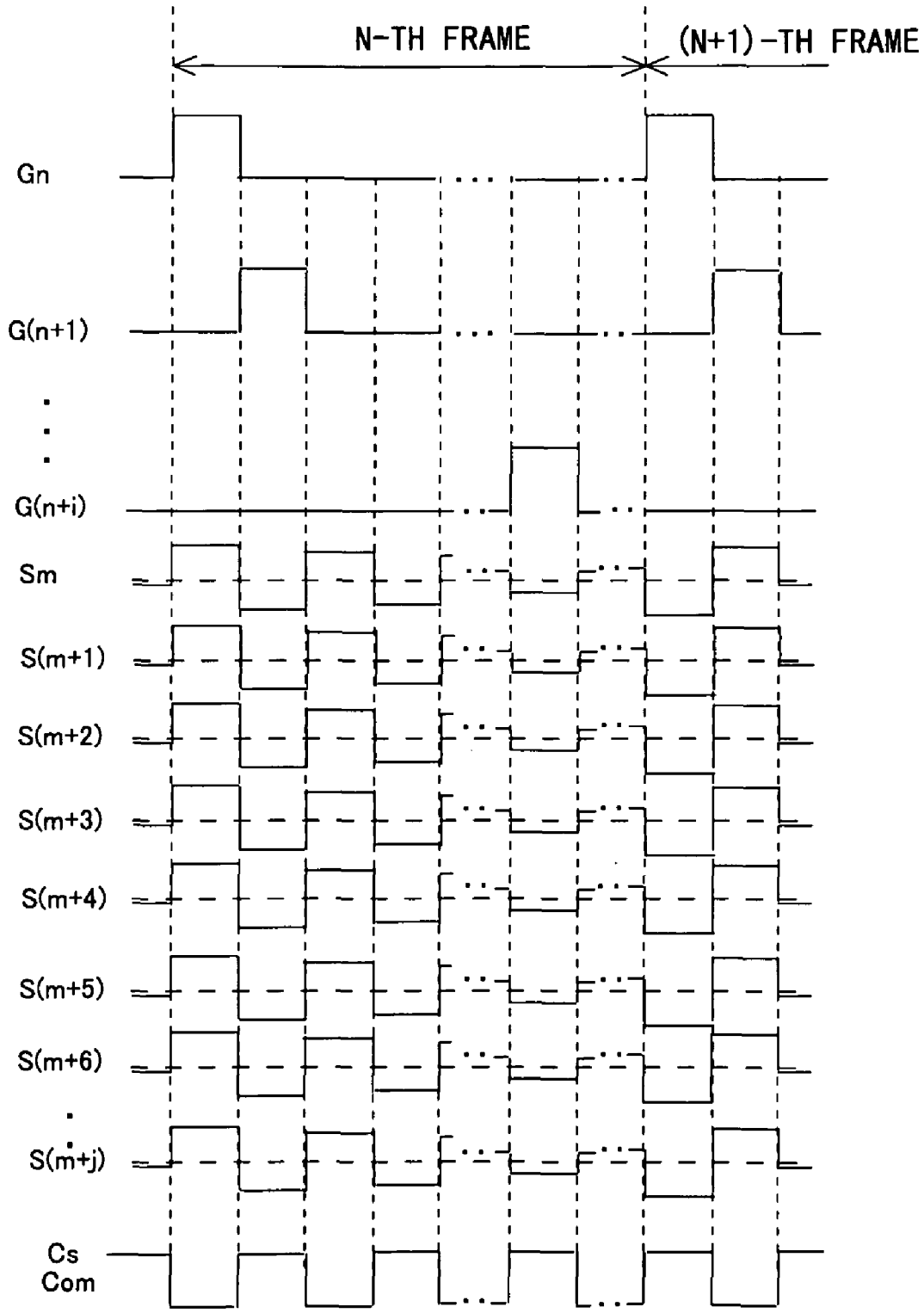
FIG. 39 is a signal waveform chart for explaining a driving method in the conventional technique.
Figure 40:
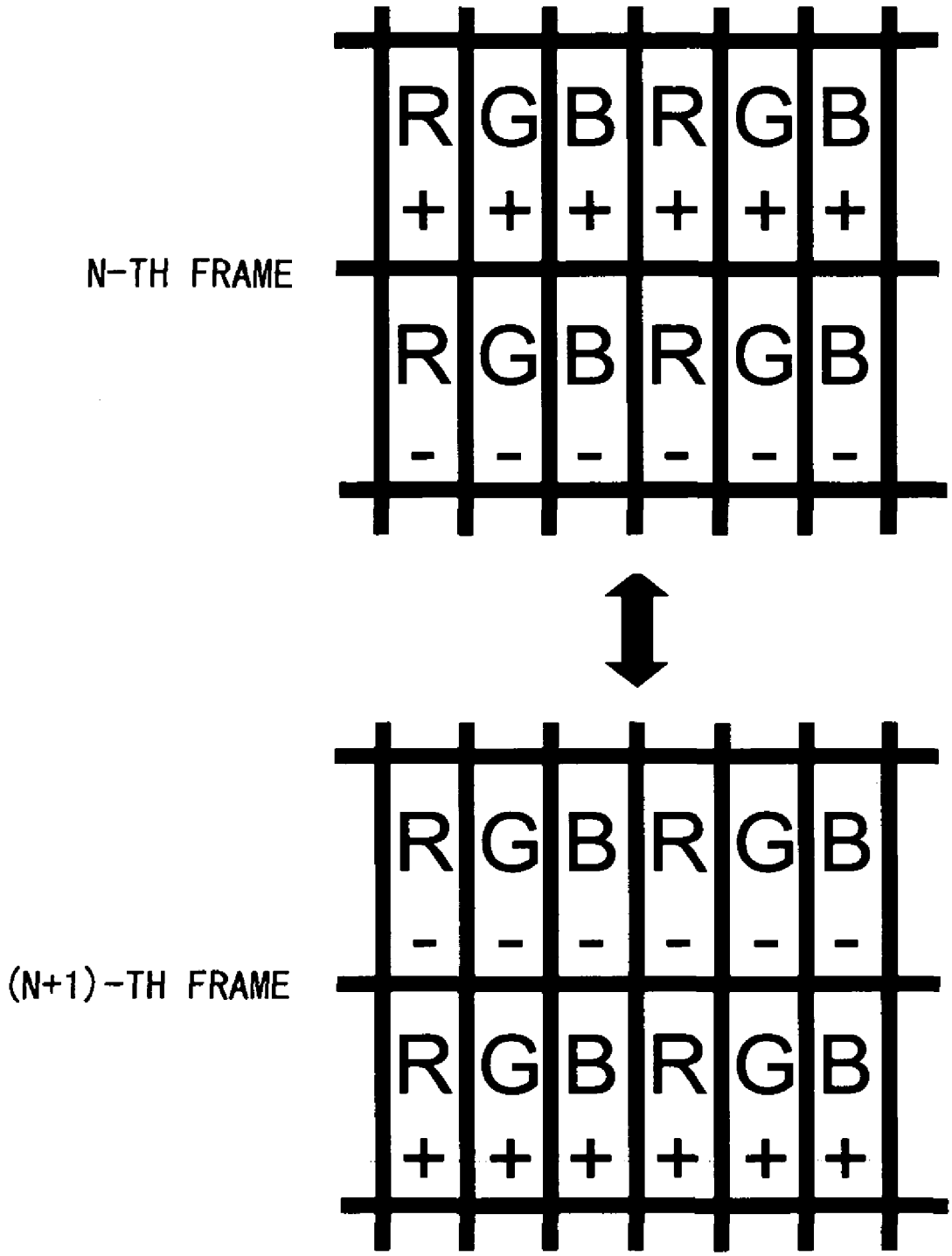
FIG. 40 is a diagram (polarity diagram) showing polarities of sub-pixels in the conventional technique.
Figure 41:
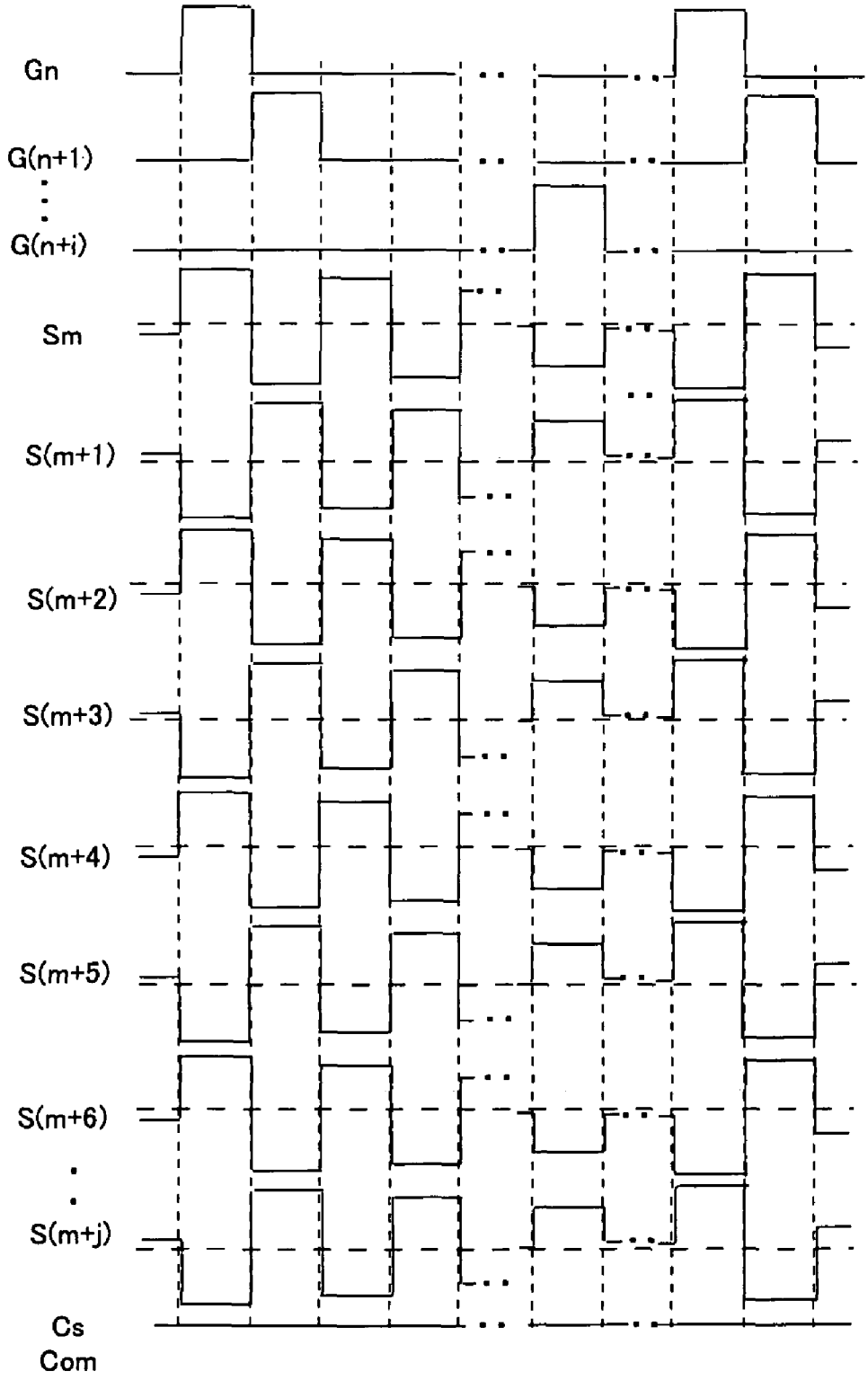
FIG. 41 is a signal waveform chart for explaining a driving method in the conventional technique.
Figure 42:
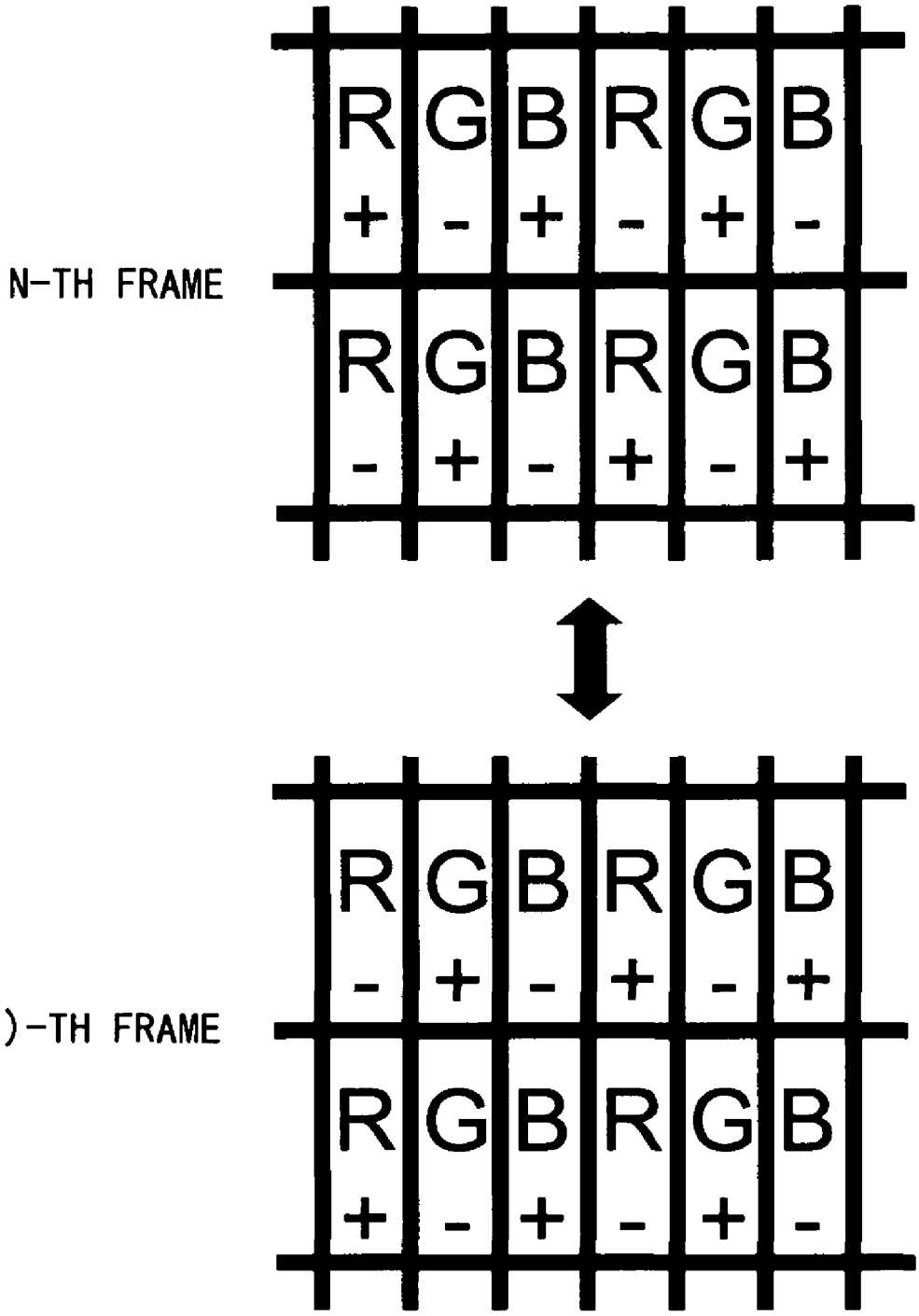
FIG. 42 is a diagram (polarity diagram) showing polarities of sub-pixels in the conventional technique.
Figure 43:
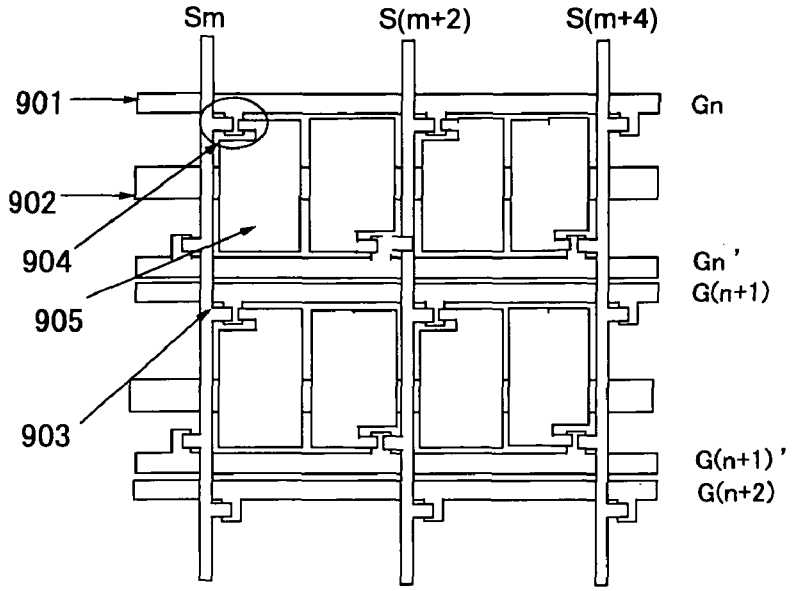
FIG. 43 is a plan view showing the configuration of a part of the display unit in the conventional technique.
Figure 44:
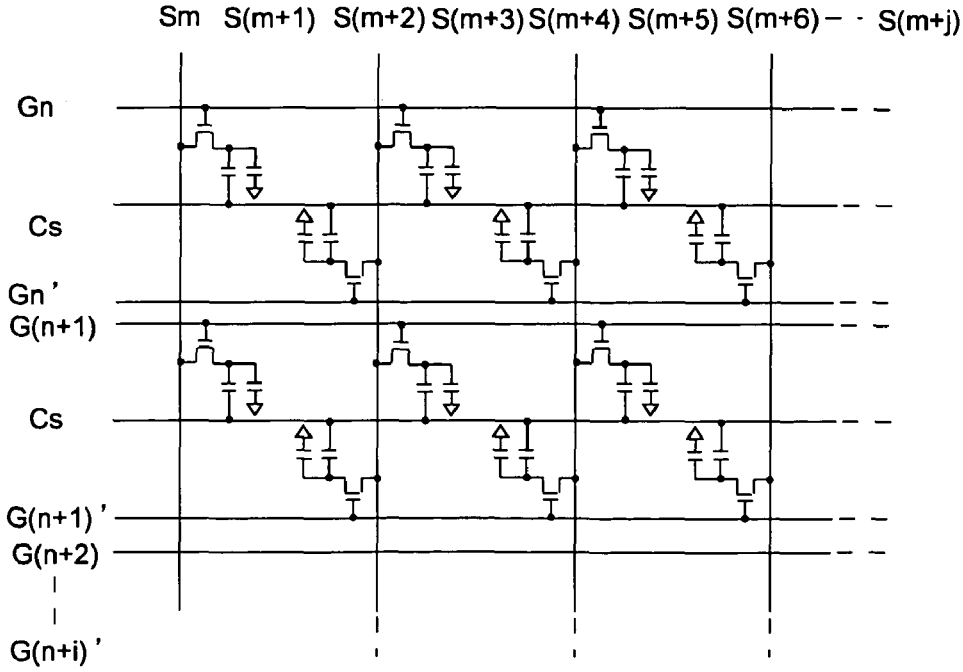
FIG. 44 is an equivalent circuit diagram showing the configuration of a part of the display unit in the conventional technique.
Figure 45:
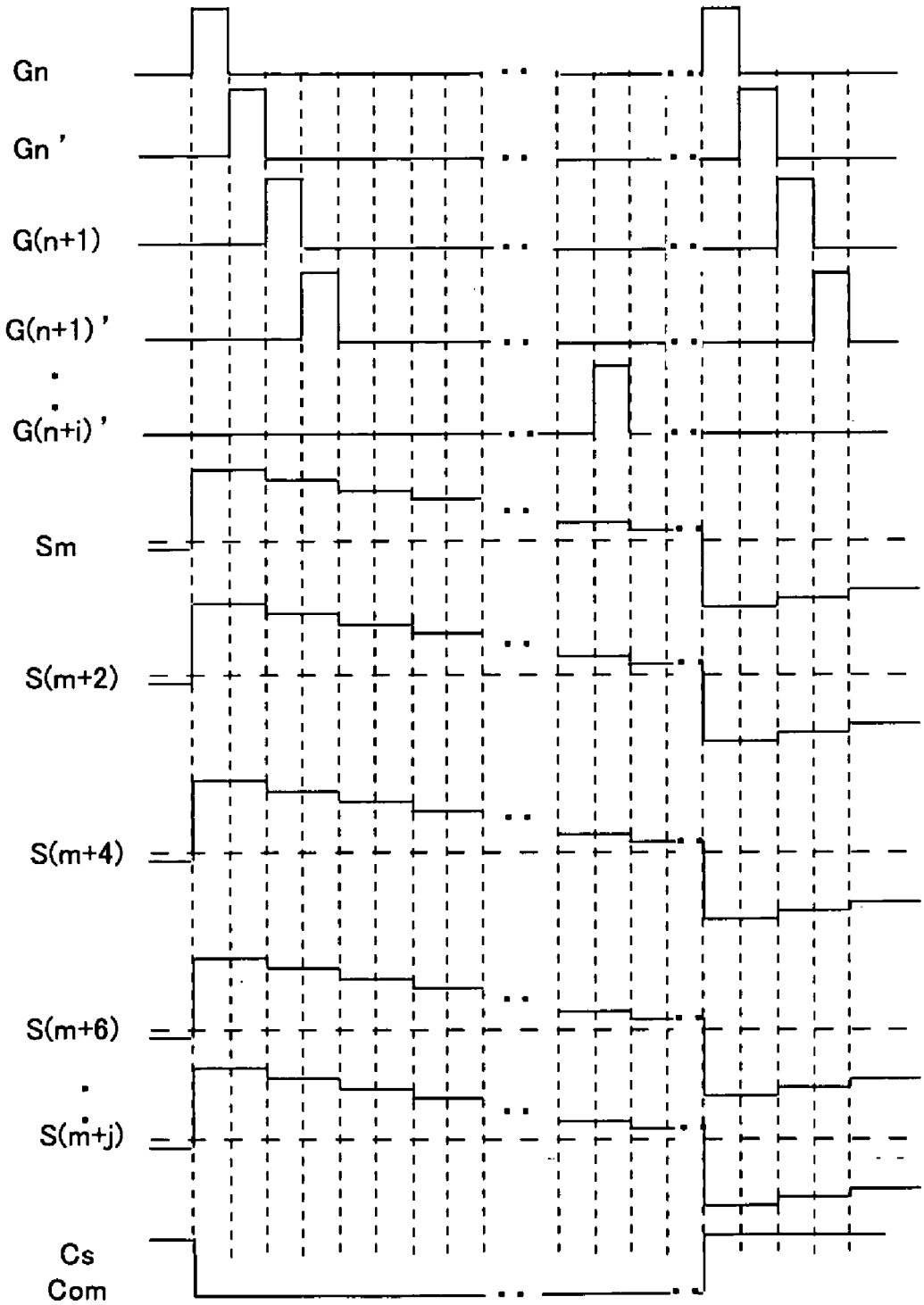
FIG. 45 is a signal waveform chart for explaining a driving method in the conventional technique.
Figure 46:
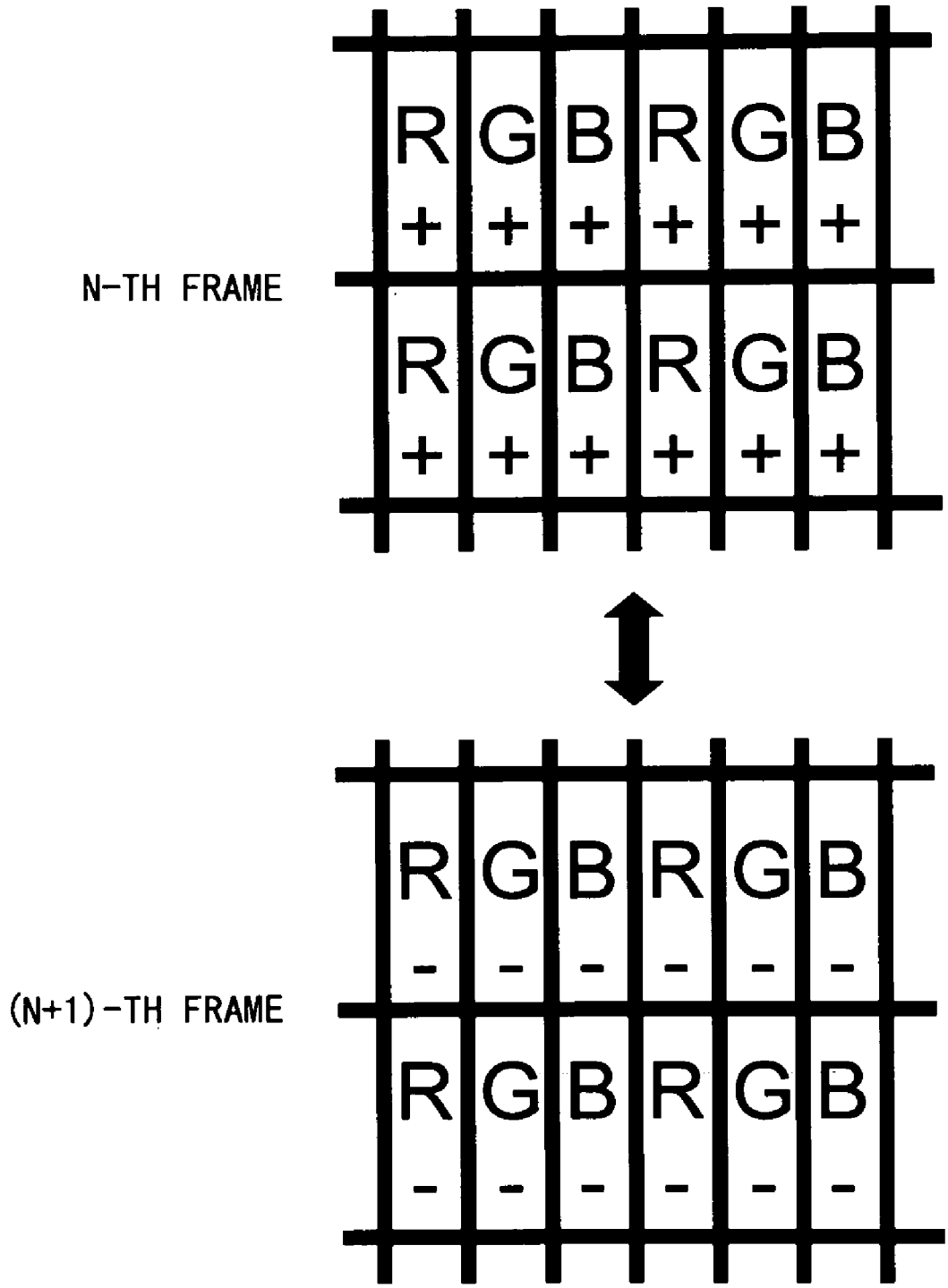
FIG. 46 is a diagram (polarity diagram) showing polarities of sub-pixels in the conventional technique.
Figure 47:
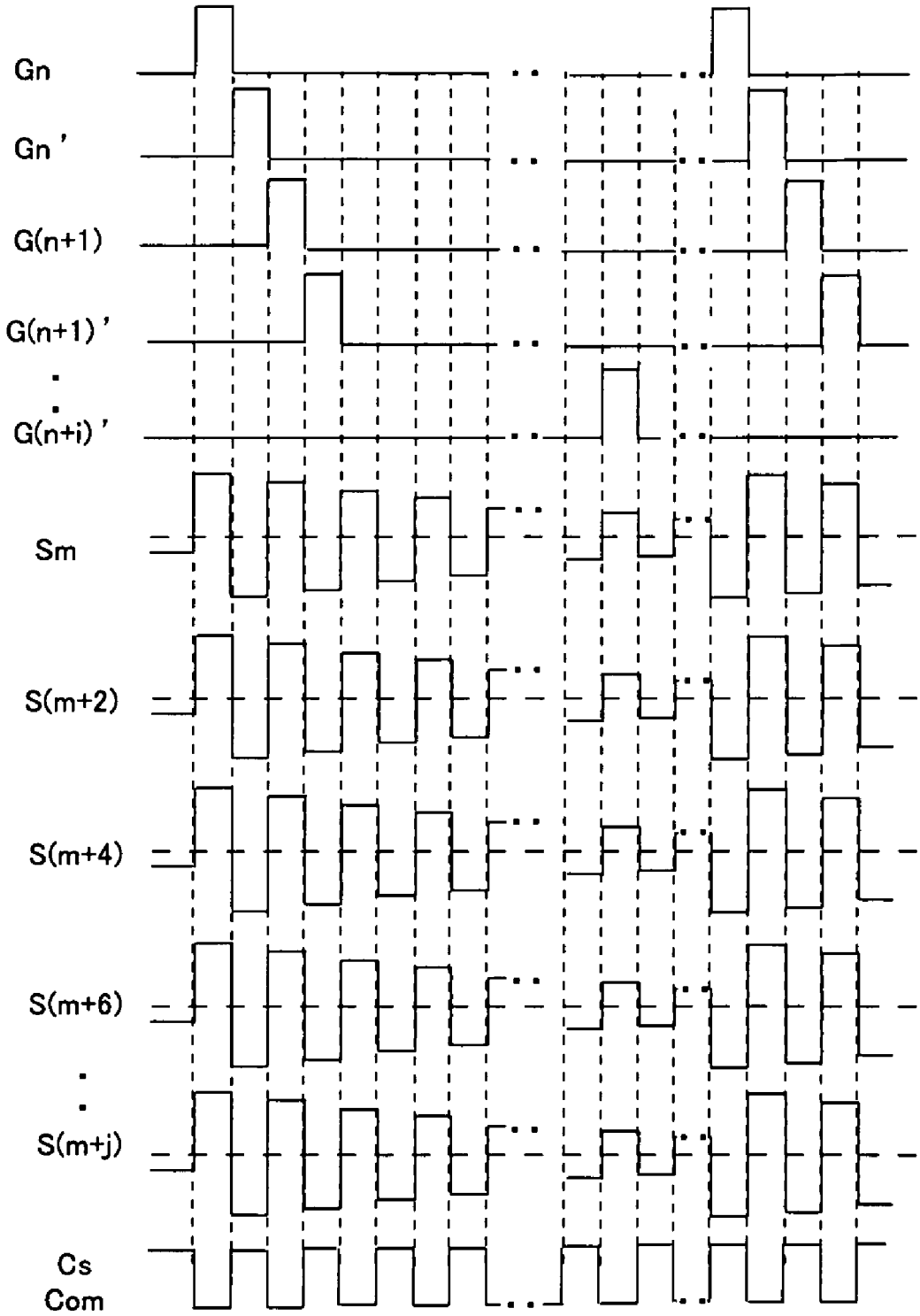
FIG. 47 is a signal waveform chart for explaining a driving method in the conventional technique.
Figure 48:
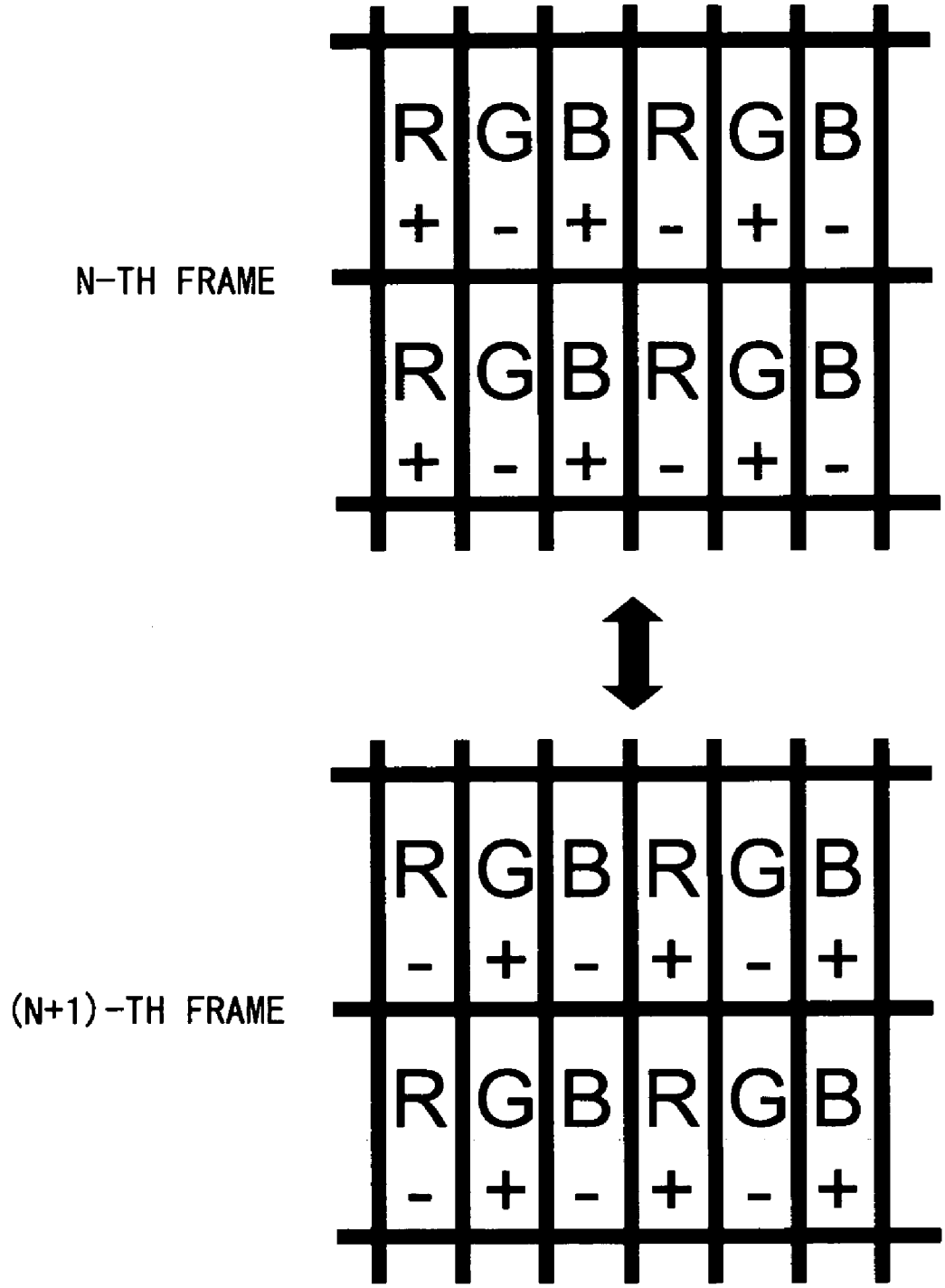
FIG. 48 is a diagram (polarity diagram) showing polarities of sub-pixels in the conventional technique.
Figure 49:
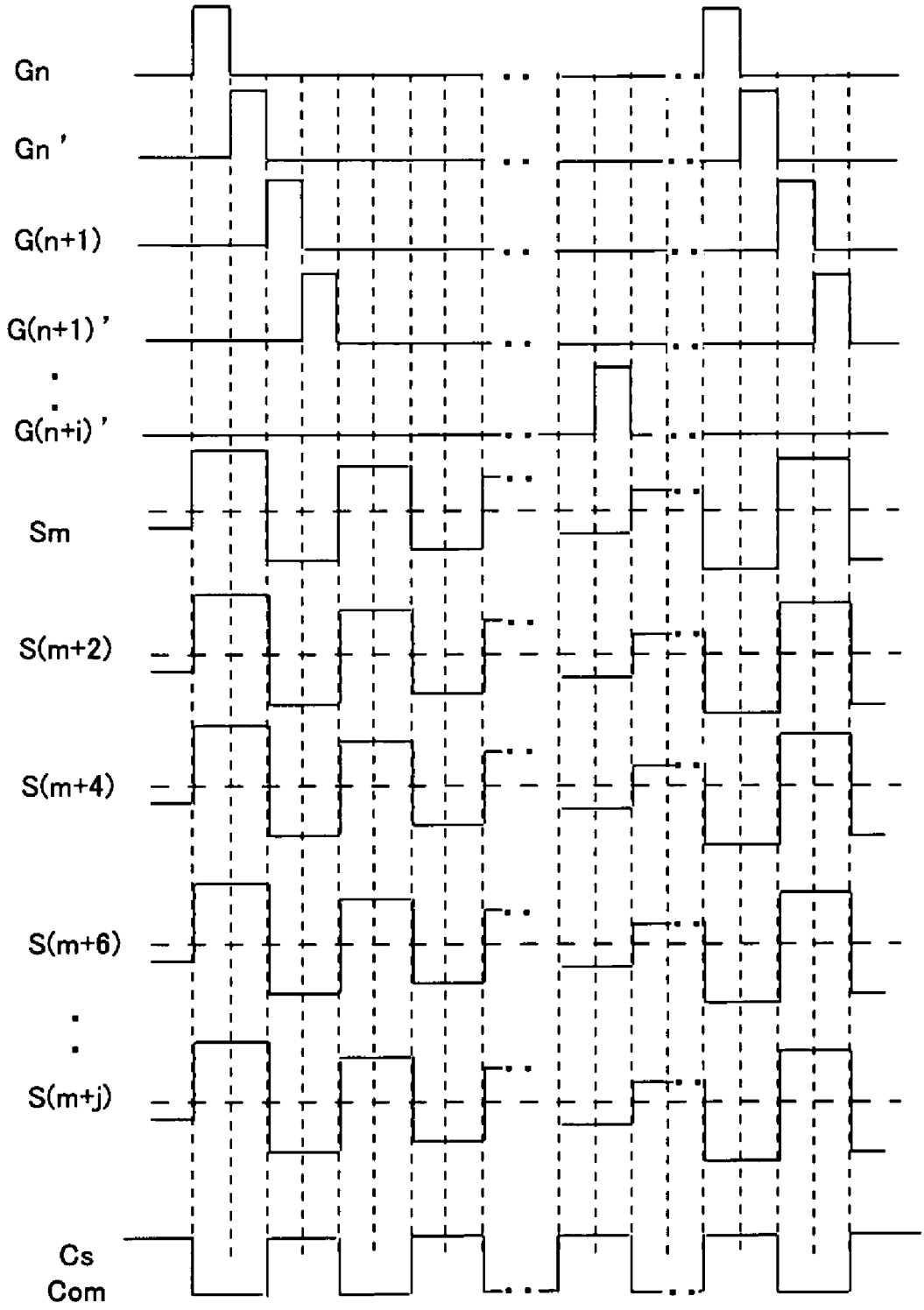
FIG. 49 is a signal waveform chart for explaining a driving method in the conventional technique.
Figure 50:
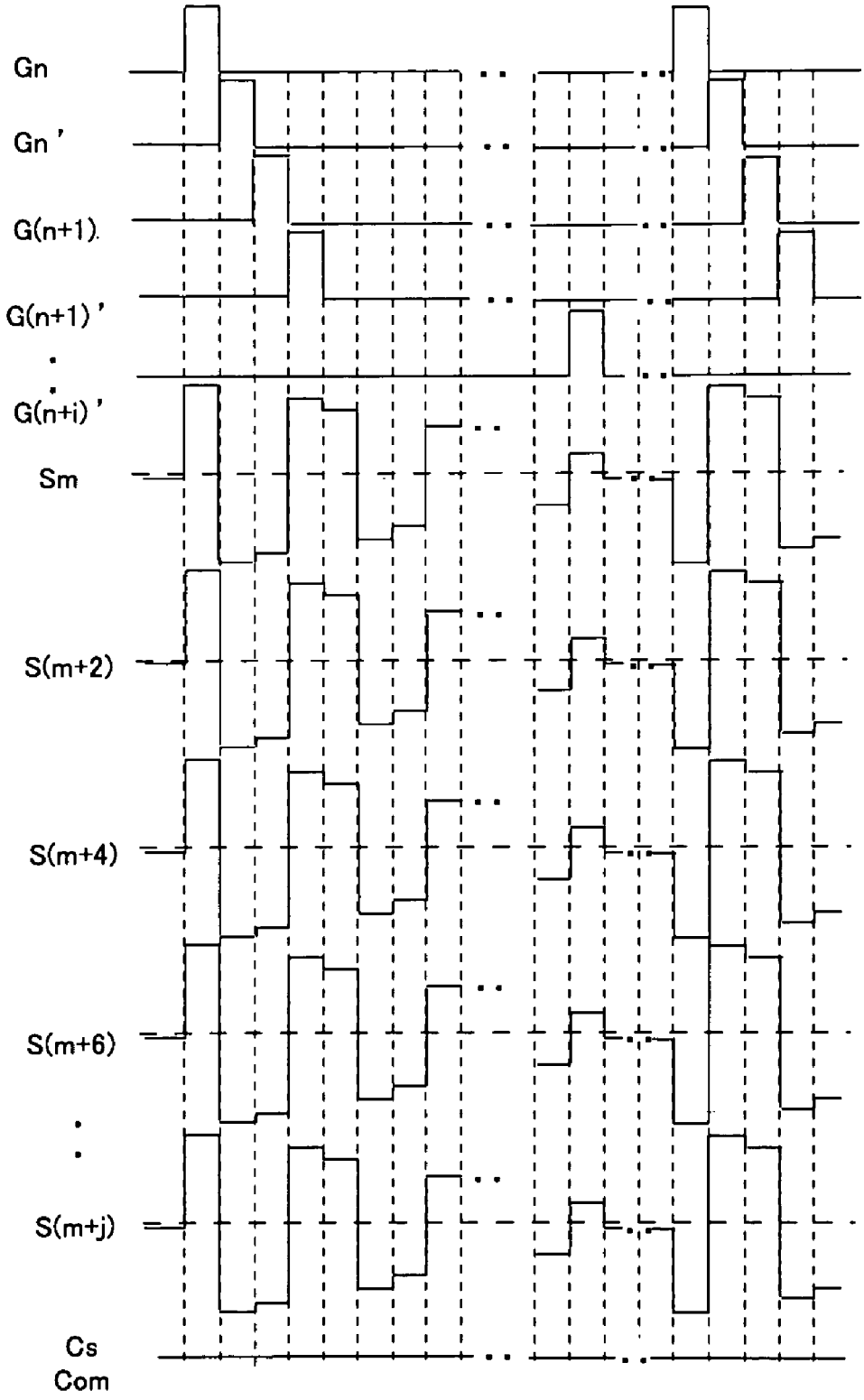
FIG. 50 is a signal waveform chart for explaining a driving method in the conventional technique.
Figure 51:
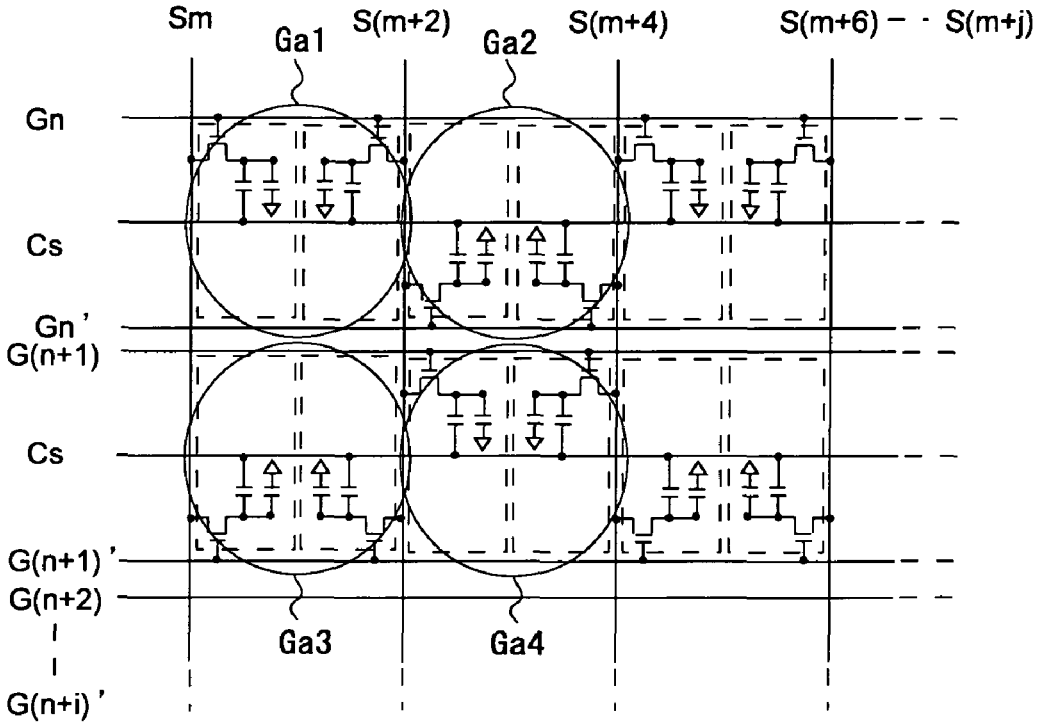
FIG. 51 is an equivalent circuit diagram showing the configuration of a part of the display unit in the conventional technique.
Figure 52:
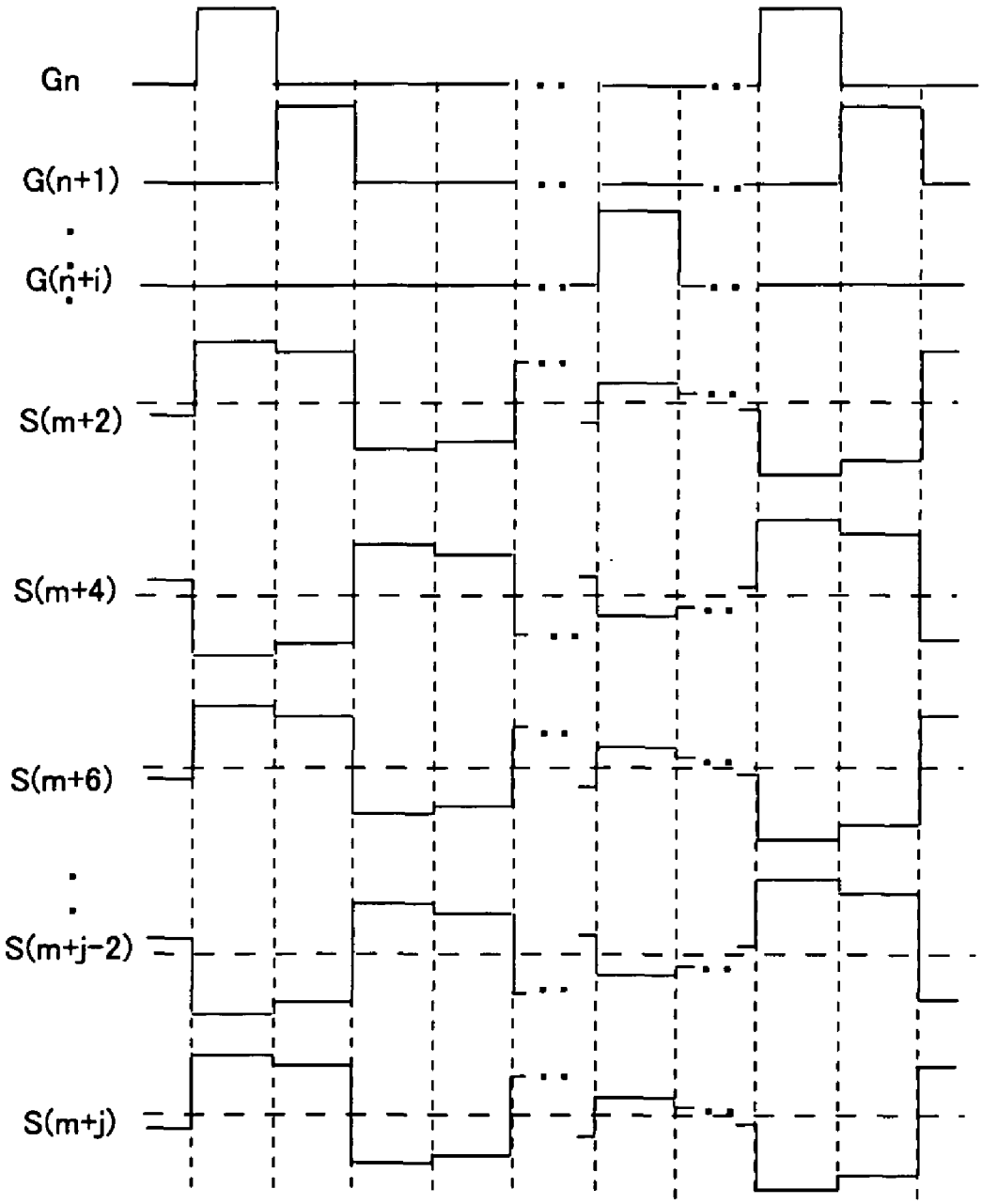
FIG. 52 is a signal waveform chart for explaining a driving method in the conventional technique.
Figure 53:
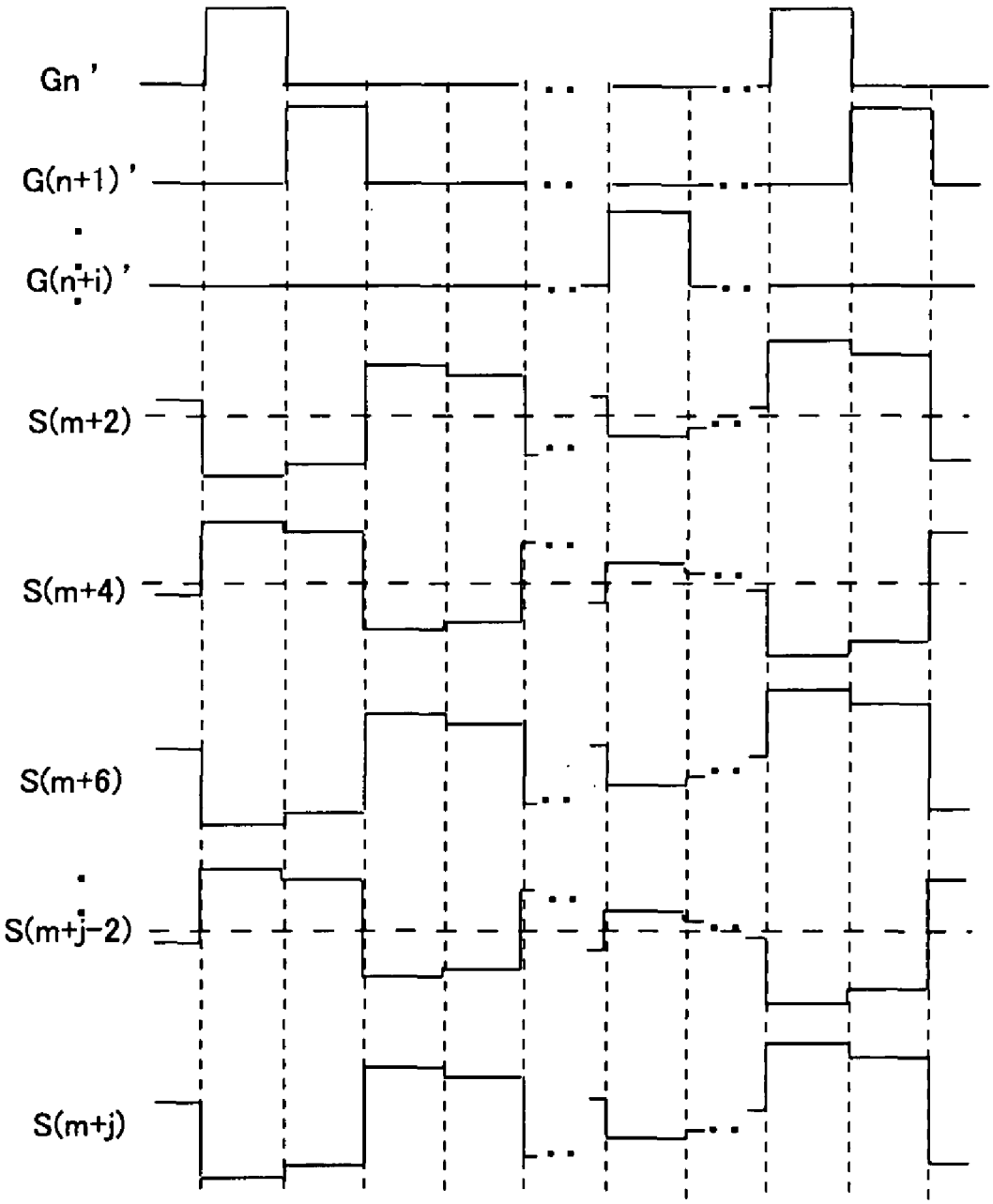
FIG. 53 is a signal waveform chart for explaining a driving method in the conventional technique.

In the embodiment, although the number of gate bus lines is twice as many as that in the liquid crystal display device having a general configuration as shown in FIGS. 37 and 38, the number of source bus lines is the half. Since the source driver is generally more expensive than the gate driver, the cost is reduced in the embodiment.

Further, according to the embodiment, all of the polarities of the drive video signals in each horizontal scanning period are the same. Consequently, as shown in FIGS. 8 and 9, opposite AC driving can be employed as a method of driving a common electrode. In the case of employing the opposite AC driving, since the amplitude of the drive video signal can be made smaller (as compared with that in opposite DC driving), power consumption can be reduced. Moreover, since a source driver having relatively low withstand voltage can be employed, the cost can be reduced.

Further, in the case of employing sub-pixel rendering method of processing each of the sub-pixels of red, green, and blue (not as a unit), the pitch (distance) between neighboring source bus lines becomes shorter, occurrence of leak failure is suppressed, and power consumption is reduced.

As described above, according to the embodiment, the display device capable of suppressing occurrence of flicker without increasing the power consumption can be realized at low cost.

1.6 Modification

Although each pixel is formed by sub-pixels of three colors of red, green, and blue in the foregoing embodiment, the invention is not limited to this. For example, the invention can be also applied to a liquid crystal display device in which each pixel is formed by sub-pixels of four colors of red, green, blue, and white (W). This will be described below as a modification.

Figure 12:
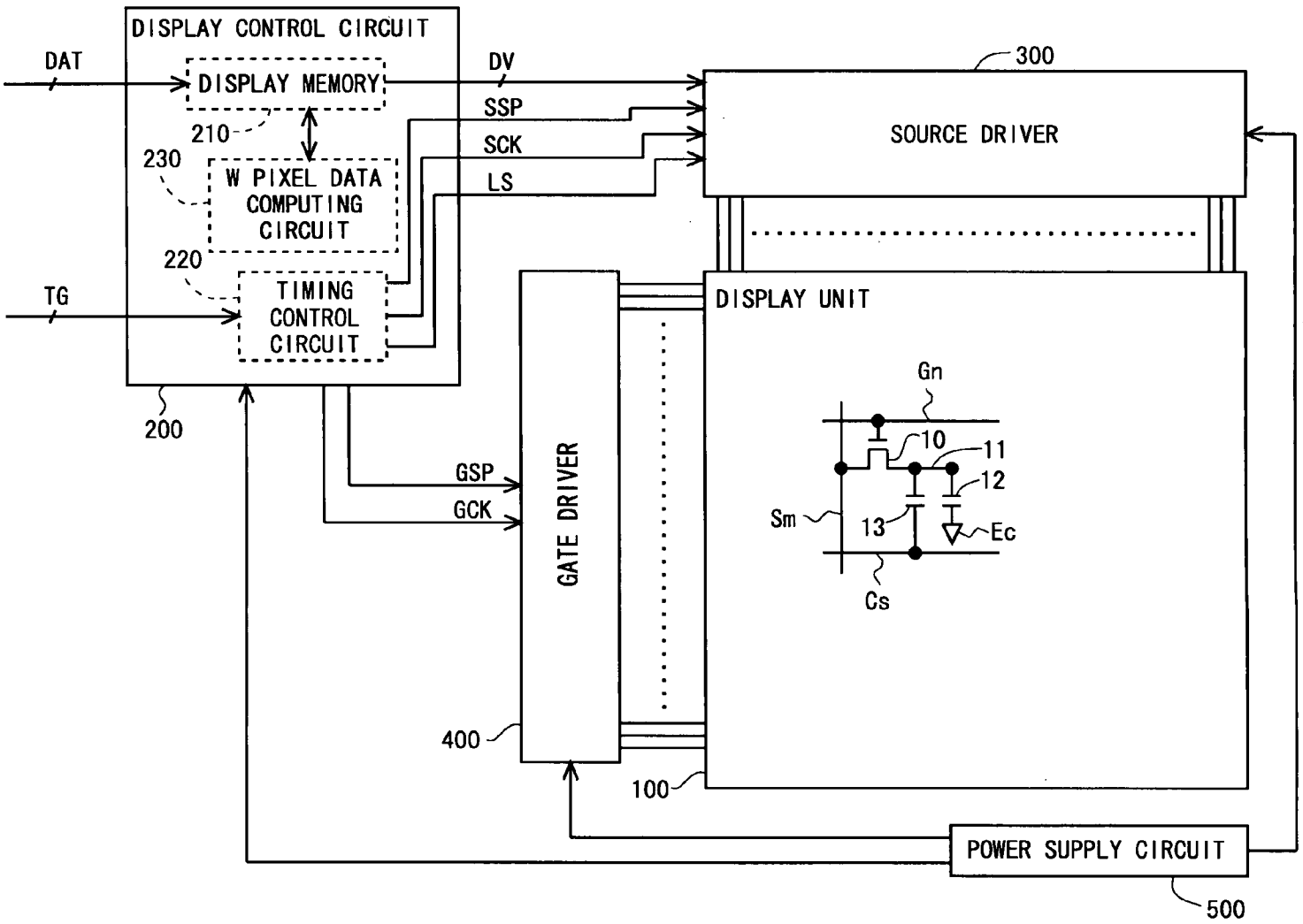
FIG. 12 is a block diagram showing a general configuration of a liquid crystal display device in a modification of the first embodiment.

FIG. 12 is a block diagram showing a general configuration of a liquid crystal display device according to a modification of the first embodiment. In addition to the components in the first embodiment shown in FIG. 2, a W pixel data computing circuit 230 is provided in the display control circuit 200. The W pixel data computing circuit 230 generates image data indicative of a tone value of a sub-pixel of white based on the image data DAT of three primary colors of red, green, and blue. Note that, the image data for the sub-pixel of white generated by the W pixel data computing circuit 230 is transmitted as a part of the digital video signal DV from the display control circuit 200 to the source driver 300.

Figure 13:
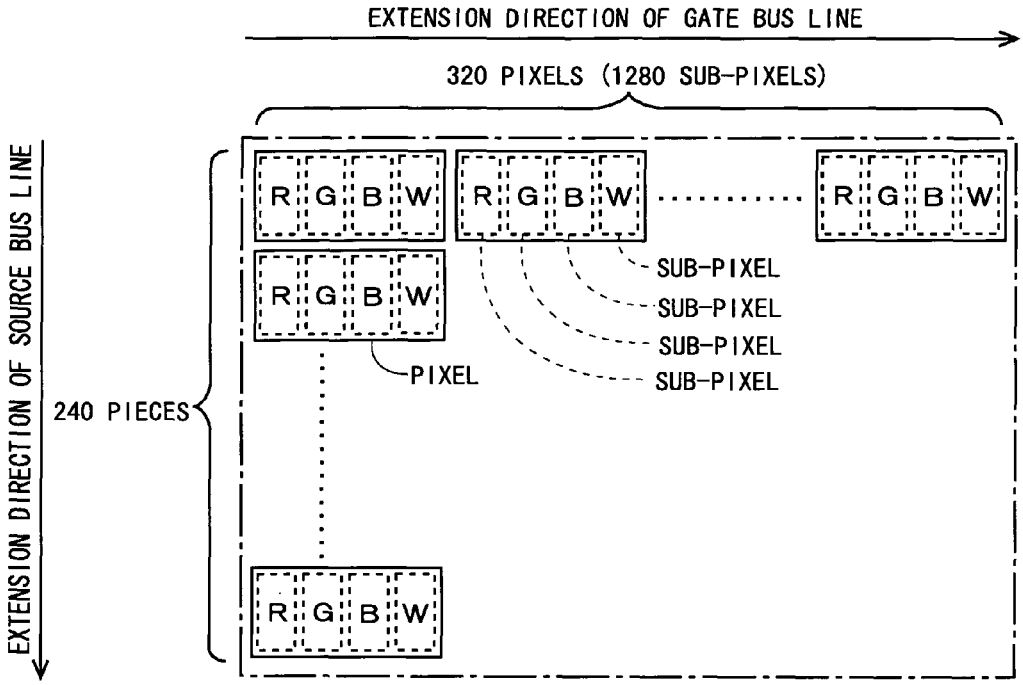
FIG. 13 is a plan view for explaining an array of pixels in the modification.
Figure 14:
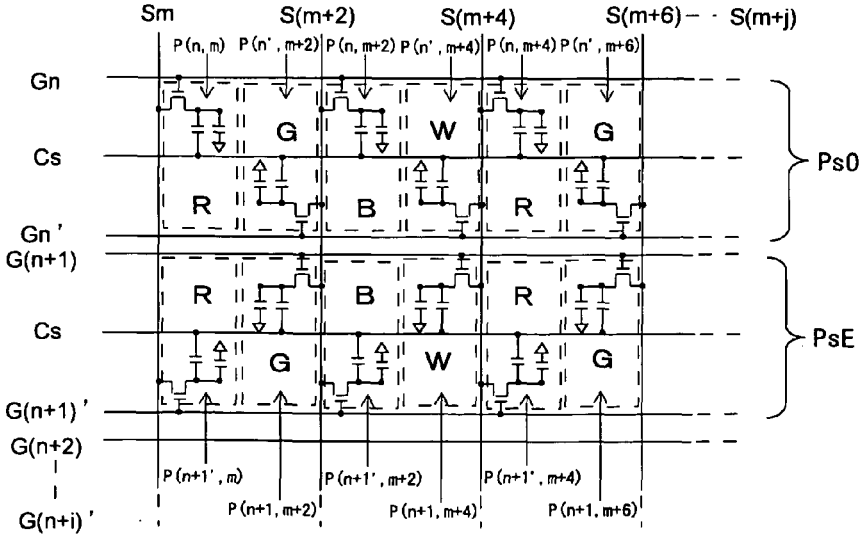
FIG. 14 is a plan view showing the configuration of a part of a display unit in the modification.

FIG. 13 is a plan view for explaining an array of pixels in the modification. In the modification, one pixel is formed by a sub-pixel of red (R), a sub-pixel of green (G), a sub-pixel of blue (B), and a sub-pixel of white (W). In the extension direction of the gate bus line, 320 pixels, that is, 1,280 sub-pixels are formed. In the extension direction of the source bus line, 240 pixels (sub-pixels) are formed. FIG. 14 is an equivalent circuit diagram showing the configuration of a part of the display unit 100 in the modification. As compared with the configuration in the first embodiment shown in FIG. 1, the sub-pixel of white (W) is added in the modification. However, when paying attention to two sub-pixels included in a region surrounded by two neighboring source bus lines and two gate bus lines disposed on the upper and lower sides, the positional relation (connection relation) between the two sub-pixels and the source bus lines and the gate bus lines is similar to that of the first embodiment.

In the configuration, in a manner similar to the first embodiment, signals are outputted in the odd-numbered frame as shown in FIG. 8, and signals are outputted in the even-numbered frame as shown in FIG. 9. As a result, a polarity diagram in the odd-numbered frame is as shown in FIG. 15, and a polarity diagram in the even-numbered frame is as shown in FIG. 16. As described above, in the modification, also in the liquid crystal display device in which each pixel is formed by sub-pixels of four colors, without increasing power consumption, occurrence of flicker can be suppressed.

Note that, although the W pixel data computing circuit 230 is provided in the display control circuit 200 in the modification, the W pixel data computing circuit 230 may be provided in the source driver 300. Also, in the modification, the liquid crystal display device in which each pixel is formed by sub-pixels of four colors of red, green, blue, and white has been described as an example. However, the present invention is not limited to this. The invention can be also applied to a liquid crystal display device in which a pixel is formed by sub-pixels of four colors including a sub-pixel of, for example, yellow or cyan in place of white, and to a liquid crystal display device in which a pixel is formed by sub-pixels of five or more colors.

2. Second Embodiment

2.1 About an Array of Pixels

Figure 17:
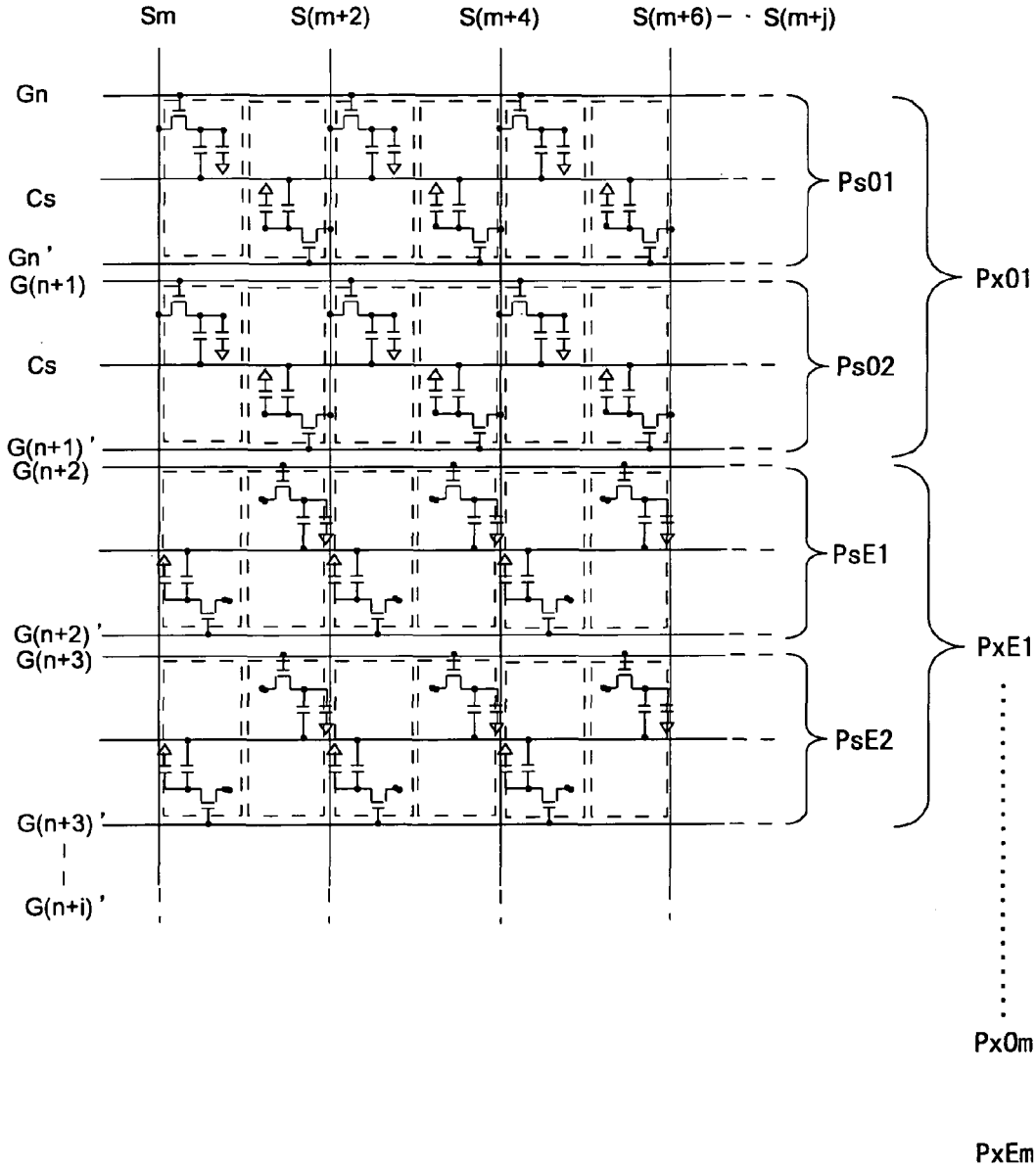
FIG. 17 is an equivalent circuit diagram showing the configuration of a part of a display unit in a liquid crystal display device according to a second embodiment of the invention.

The general configuration of a liquid crystal display device according to a second embodiment of the present invention is similar to that of the first embodiment, so that it will not be described. FIG. 17 is an equivalent circuit diagram showing the configuration of a part of the display unit 100 in the embodiment. In the embodiment, the array of pixels is different from that of the first embodiment (see FIG. 1). The n-th row and the (n+1)th row have similar configurations, and the (n+2)th row and the (n+3)th row have similar configurations.

In the n-th row and the (n+1)th row, with respect to the sub-pixel disposed on the left side out of the two sub-pixels disposed between neighboring two source bus lines, the gate terminal of the TFT 10 is connected to the gate bus line disposed on the upper side of the sub-pixel, and with respect to the sub-pixel disposed on the right side, the gate terminal of the TFT 10 is connected to the gate bus line disposed on the lower side of the sub-pixel. Accordingly, with respect to the sub-pixel disposed on the left side, a scanning signal is supplied from the gate bus line disposed on the upper side of the sub-pixel, and with respect to the sub-pixel disposed on the right side, a scanning signal is supplied from the gate bus line disposed on the lower side of the sub-pixel.

In the (n+2)th row and the (n+3)th row, with respect to the sub-pixel disposed on the left side out of the two sub-pixels disposed between neighboring two source bus lines, the gate terminal of the TFT 10 is connected to the gate bus line disposed on the lower side of the sub-pixel, and with respect to the sub-pixel disposed on the right side, the gate terminal of the TFT 10 is connected to the gate bus line disposed on the upper side of the sub-pixel. Accordingly, with respect to the sub-pixel disposed on the left side, a scanning signal is supplied from the gate bus line disposed on the lower side of the sub-pixel, and with respect to the sub-pixel disposed on the right side, a scanning signal is supplied from the gate bus line disposed on the upper side of the sub-pixel.

Figure 18:
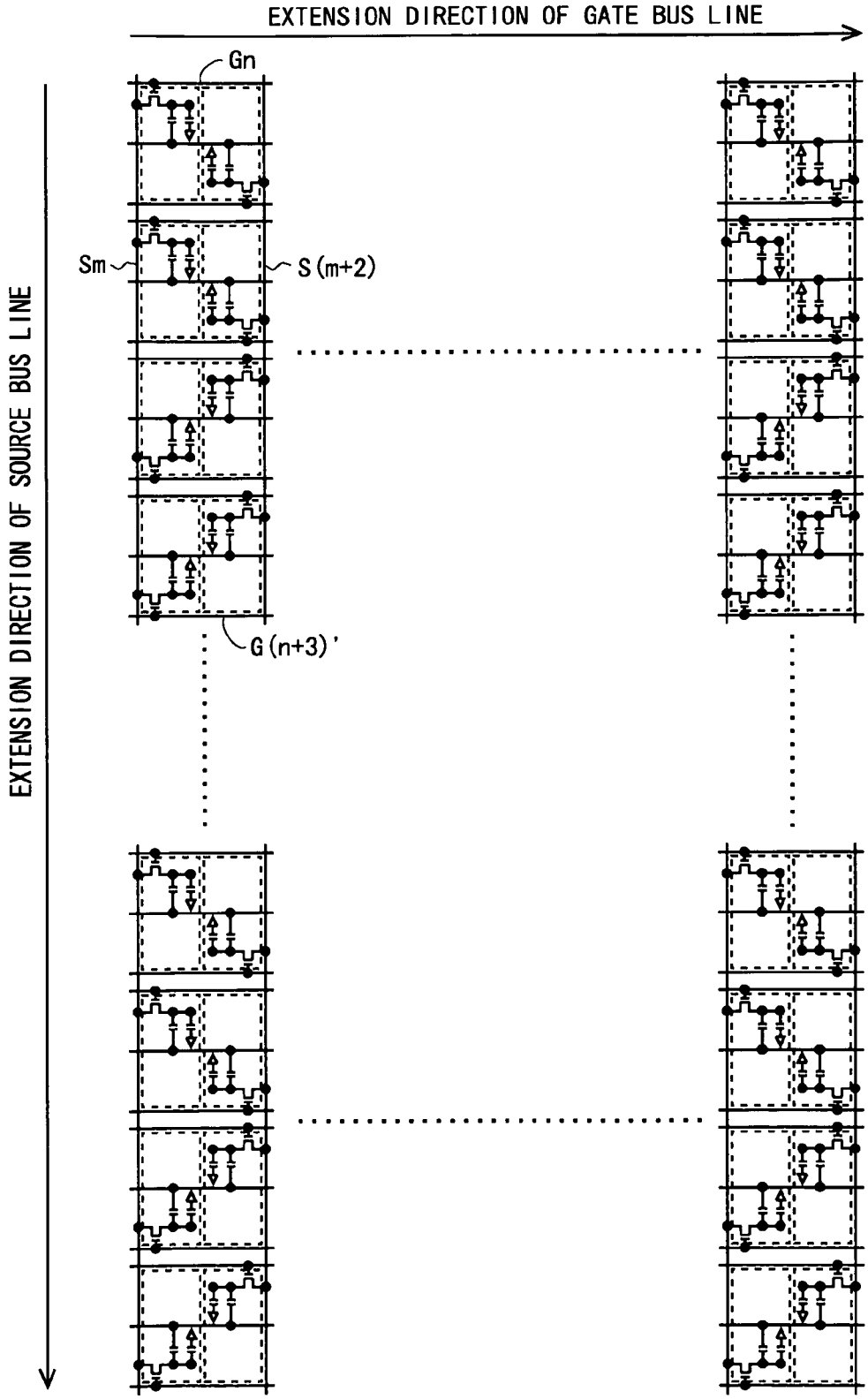
FIG. 18 is a plan view for explaining an array of pixels in the entire display unit in the second embodiment.

When eight sub-pixels surrounded by the two gate bus lines Gn and G(n+3)' and two source bus lines Sm and S(m+2) are used as a configuration unit as a collection, as shown in FIG. 18, a configuration similar to the configuration unit is repeated in the extension direction of the gate bus lines and the extension direction of the source bus lines.

2.2 Driving Method

Next, a driving method in the embodiment will be described. In the embodiment, interlace driving for displaying one screen by two vertical scans is performed. In the following description, it is assumed that an odd-numbered frame and an even-numbered frame are alternately repeated, and each frame (each of the odd-numbered and even-numbered frames) includes first and second fields.

Figure 19:
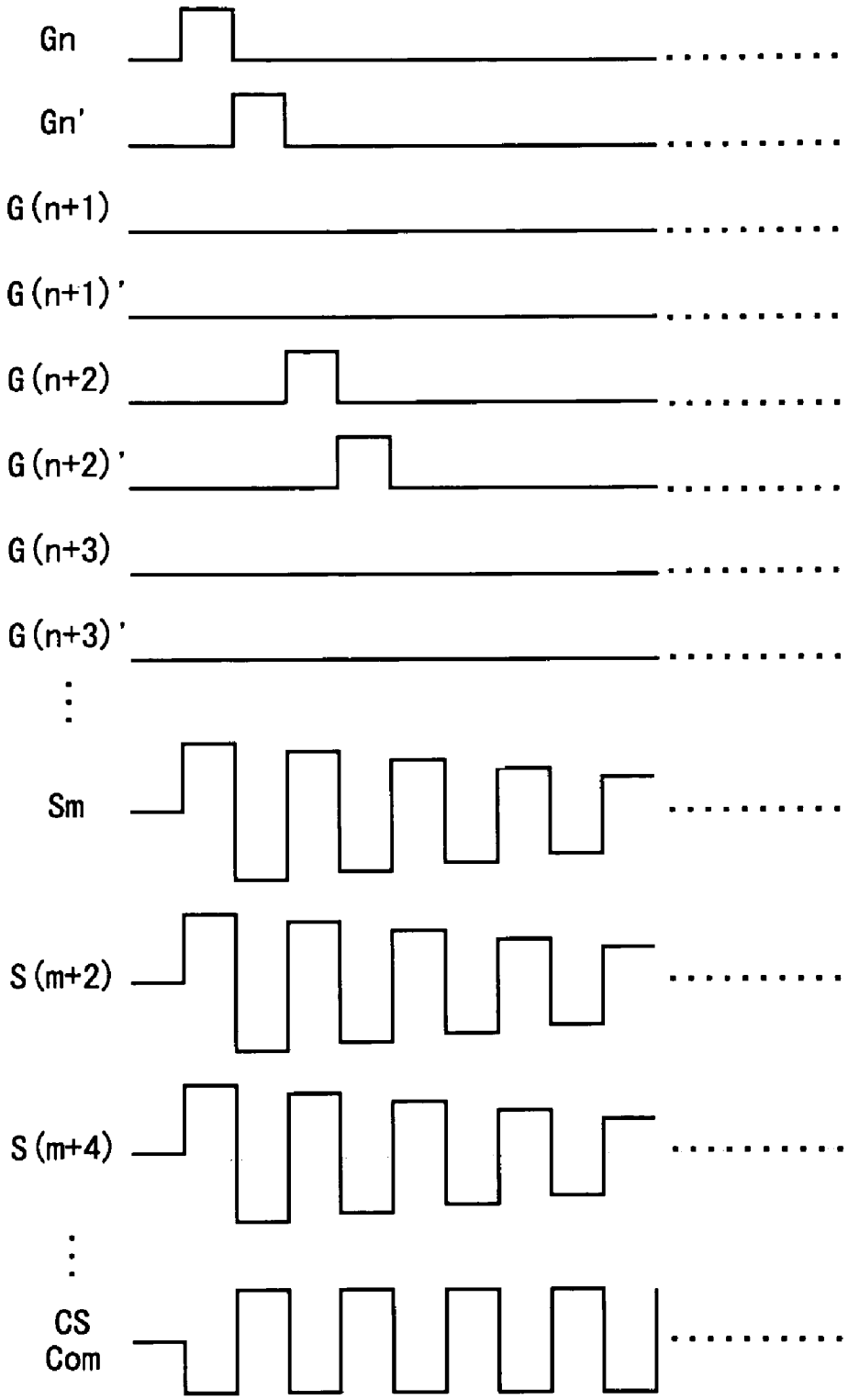
FIG. 19 is a signal waveform chart for explaining a driving method in a first field of an odd-numbered frame in the second embodiment.

FIG. 19 is a signal waveform chart in the first field in an odd-numbered frame. As shown in FIG. 19, first, an active scanning signal is applied to the gate bus line Gn disposed on the upper side of the n-th row. At this time, all of the polarities of drive video signals applied to each source bus line are positive. Accordingly, all of the polarities of sub-pixels which receive supply of the scanning signal from the gate bus line Gn become positive. Next, the active scanning signal is applied to the gate bus line Gn' disposed on the lower side of the n-th row. At this time, all of the polarities of the drive video signals applied to each source bus line are negative. Accordingly, all of the polarities of the sub-pixels which receive supply of the scanning signal from the gate bus line Gn' become negative.

Next, an active scanning signal is applied to the gate bus line Gn disposed on the upper side of the (n+2)th row. At this time, all of the polarities of drive video signals applied to the source bus lines are positive. Accordingly, all of the polarities of sub-pixels which receive supply of the scanning signal from the gate bus line G(n+2) become positive. Further, the active scanning signal is applied to the gate bus line G(n+2)' disposed on the lower side of the (n+2)th row. At this time, all of the polarities of the drive video signals applied to the source bus lines are negative. Accordingly, all of the polarities of the sub-pixels which receive supply of the scanning signal from the gate bus line G(n+2)' become negative.

In this case, no active scanning signal is applied to the gate bus lines G(n+1) and G(n+1)' disposed on the upper and lower sides of the (n+1)th row. Consequently, with respect to the polarity of the sub-pixel in the (n+1)th row, the polarity in the field immediately preceding the period (the second field in an even-numbered frame which will be described later) is maintained. Similarly, since no active scanning signal is applied also to the gate bus lines G(n+3) and G(n+3)', the polarity in the second field in an even-numbered frame is maintained also with respect to the polarity of the sub-pixel in the (n+3)th row.

As described above, when attention is paid to the gate bus lines, the active scanning signal is applied while skipping two gate bus lines. When attention is paid to the rows, the active scanning signal is applied to two gate bus lines disposed on the upper and lower sides of the row while skipping one row. When the active scanning signal is applied to the gate bus line disposed on the upper side of each row, all of the polarities of the drive video signal applied to each source bus line are positive. When the active scanning signal is applied to the gate bus line disposed on the lower side of each row, all of the polarities of the drive video signals applied to the source bus lines are negative.

Figure 20:
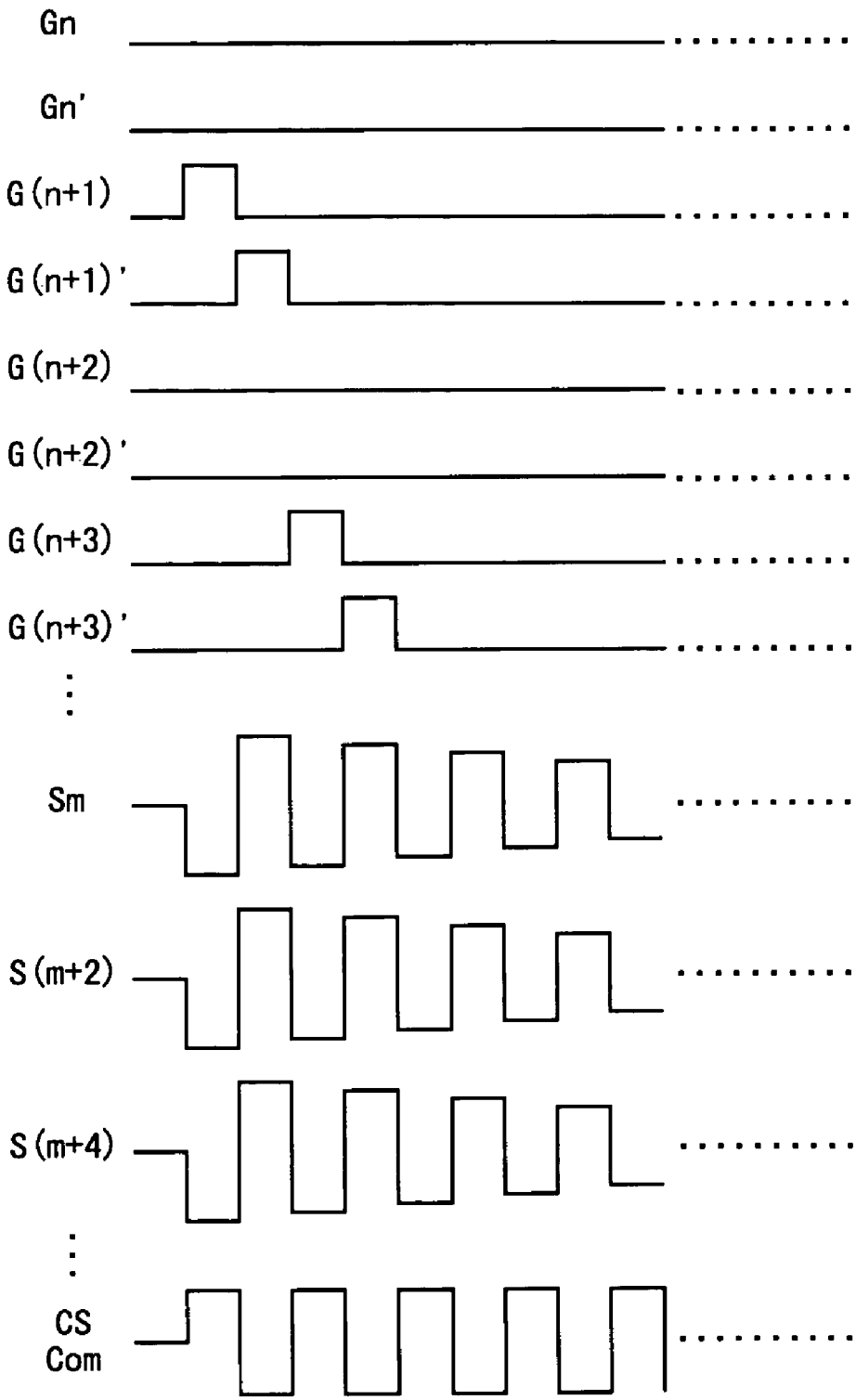
FIG. 20 is a signal waveform chart for explaining a driving method in a second field of an odd-numbered frame in the second embodiment.

FIG. 20 is a signal waveform chart in a second field in an odd-numbered frame. In the period, no active scanning signal is applied to the gate bus line Gn disposed on the upper side of the n-th row and the gate bus line Gn' disposed on the lower side of the n-th row. Consequently, with respect to the polarity of the n-th sub-pixel, the polarity in the first field of the above-described odd-numbered frame is maintained.

Thus, no active scanning signal is applied to the gate bus lines Gn and Gn', and the active scanning signal is applied to the gate bus line G(n+1) disposed on the upper side of the (n+1)th row. At this time, all of the polarities of drive video signals applied to the source bus lines are negative. Accordingly, all of the polarities of sub-pixels which receive supply of the scanning signal from the gate bus line G(n+1) become negative. Next, the active scanning signal is applied to the gate bus line G(n+1)' disposed on the lower side of the (n+1)th row. At this time, all of the polarities of the drive video signals applied to the source bus lines are positive. Accordingly, all of the polarities of the sub-pixels which receive supply of the scanning signal from the gate bus line G(n+1)' become positive.

As described above, also in this field (the second field of the odd-numbered frame), when attention is paid to the gate bus line, the active scanning signal is applied to two gate bus lines while skipping two gate bus lines and when attention is paid to the rows, the active scanning signal is applied to two gate bus lines disposed on the upper and lower sides of the row while skipping one row. In the field, the active scanning signal is applied to the gate bus line to which the active scanning signal is not applied in the first field of the odd-numbered frame. Also, different from the first field of the odd-numbered frame, when an active scanning signal is applied to the gate bus line disposed on the upper side of each row, all of the polarities of the drive video signals applied to the source bus lines are negative, and when the active scanning signal is applied to the gate bus line disposed on the lower side of each row, all of the polarities of the drive video signals applied to the source bus lines are positive.

Figure 21:
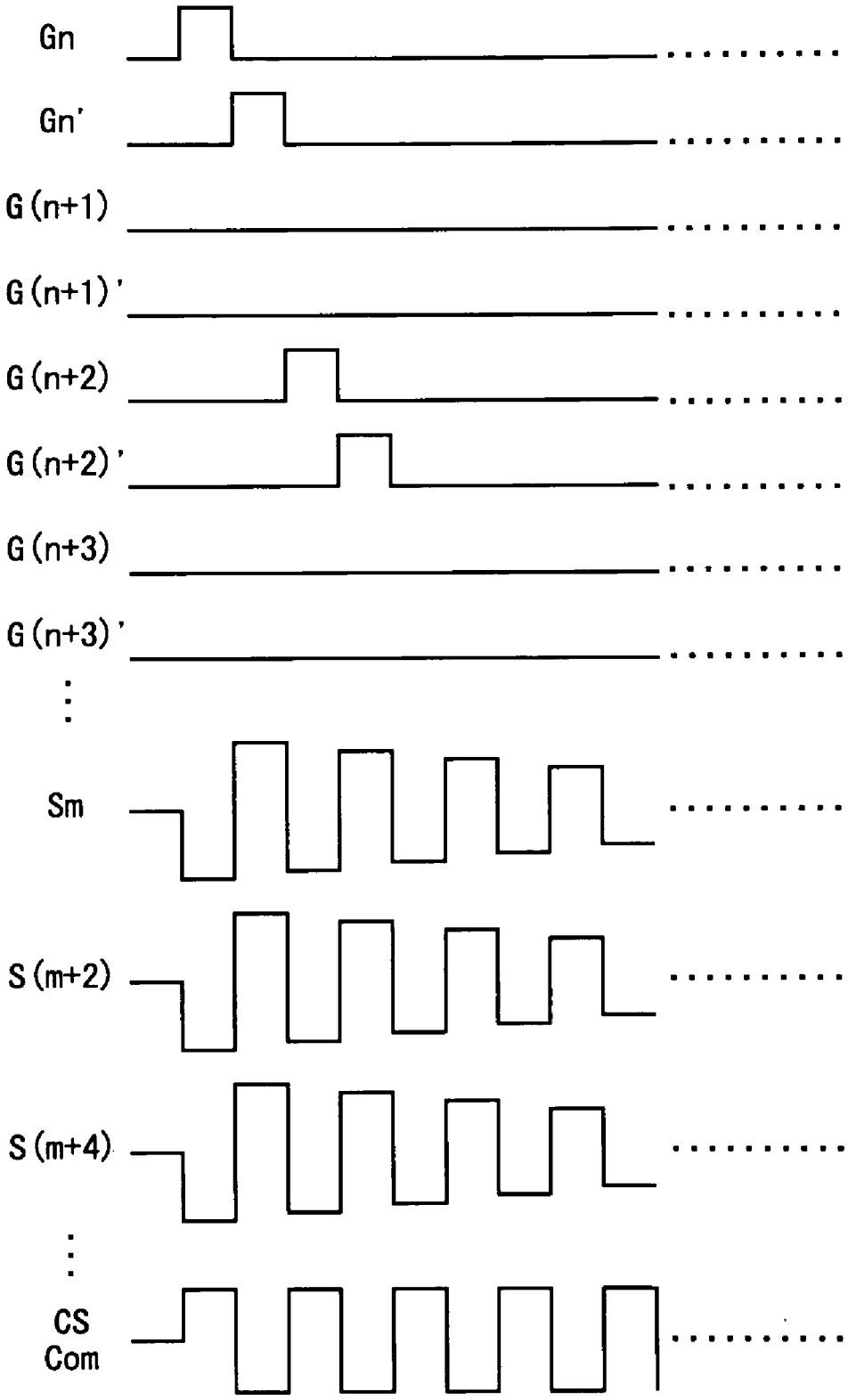
FIG. 21 is a signal waveform chart for explaining a driving method in a first field of an even-numbered frame in the second embodiment.

FIG. 21 is a signal waveform chart in the first field of an even-numbered frame. In the field, the scanning signals are the same as those in the first field of an odd-numbered frame. On the other hand, the drive video signals are different from those in the first field of an odd-numbered frame. When an active scanning signal is applied to the gate bus line disposed on the upper side of each row, all of the polarities of the drive video signals applied to the source bus lines are negative. When the active scanning signal is applied to the gate bus line disposed on the lower side of each row, all of the polarities of the drive video signals applied to the source bus lines are positive.

Figure 22:
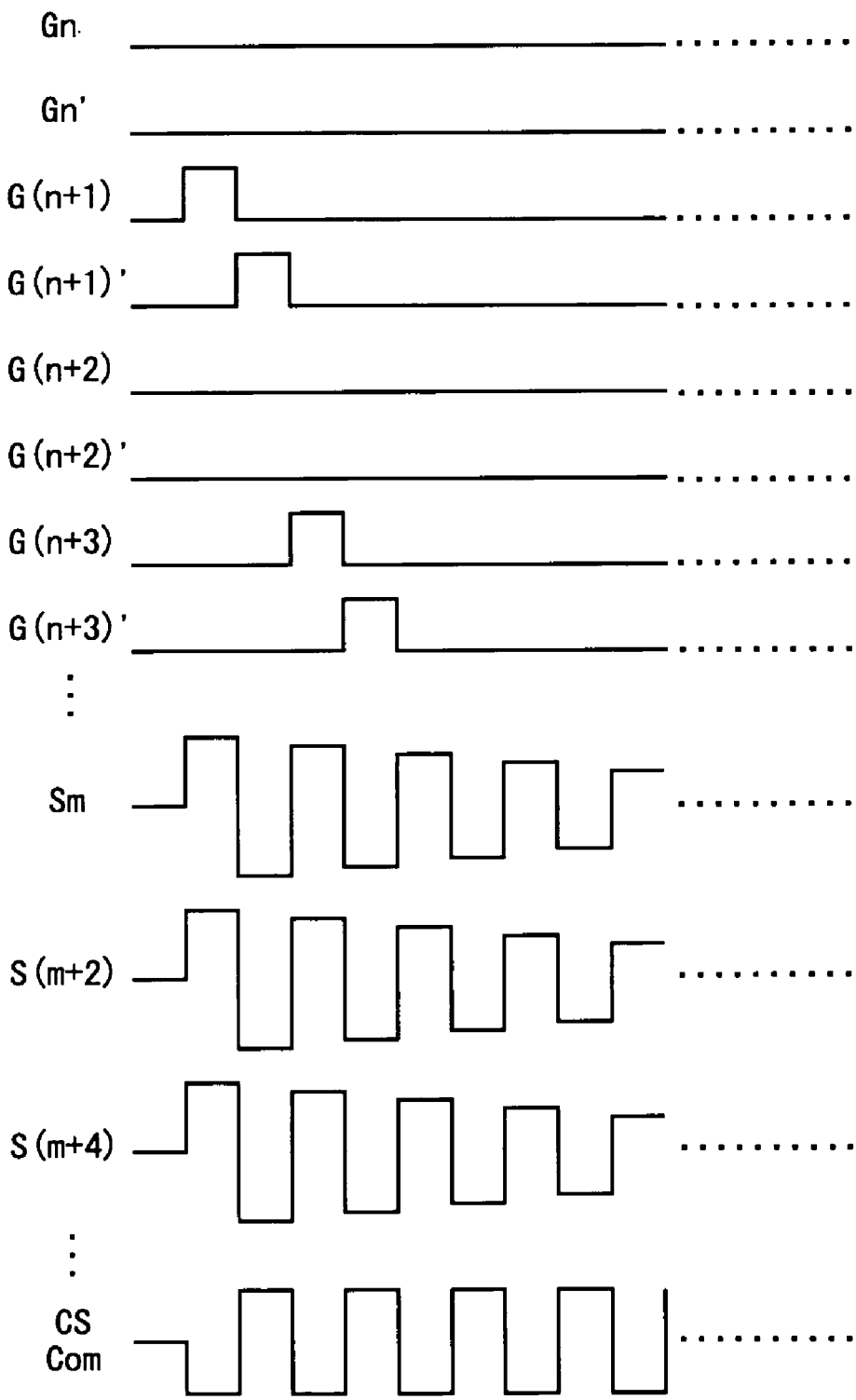
FIG. 22 is a signal waveform chart for explaining a driving method in a second field of an even-numbered frame in the second embodiment.

FIG. 22 is a signal waveform chart in the second field of an even-numbered frame. In the field, the scanning signals are the same as those in the second field of an odd-numbered frame. On the other hand, the drive video signals are different from those in the second field of an odd-numbered frame. When an active scanning signal is applied to the gate bus line disposed on the upper side of each row, all of the polarities of the drive video signals applied to the source bus lines are positive. When the active scanning signal is applied to the gate bus line disposed on the lower side of each row, all of the polarities of the drive video signals applied to the source bus lines are negative.

Note that, the polarities of the auxiliary capacitance electrode drive signal Cs and the common electrode drive signal Com are opposite to those of all of drive video signals in each horizontal scanning period in any of the fields. That is, in the embodiment, the opposite AC driving is performed.

2.3 Effect

The effect in the embodiment will now be described. FIG. 23 is a polarity diagram in the first field of an odd-numbered frame. FIG. 24 is a polarity diagram in the second field of an odd-numbered frame. FIG. 25 is a polarity diagram in the first field of an even-numbered frame. FIG. 26 is a polarity diagram in the second field of an even-numbered frame. Note that, in FIGS. 23 to 26, the sign ("+", "−") indicative of the polarity is not shown for a sub-pixel whose polarity is maintained from the immediately preceding field (sub-pixel having no change in the polarity).

As shown in FIGS. 23 to 26, in each field, when attention is paid to only a sub-pixel to which data is written (sub-pixel other than the sub-pixel whose polarity is maintained from the immediately preceding field), display similar to that in the dot inversion driving method in the conventional technique is performed. Moreover, in a manner similar to the first embodiment, although the number of gate bus lines is twice as many as that in the liquid crystal display device having a general configuration, the number of source bus lines is the half. Consequently, also in the liquid crystal display device employing the interlace driving, in a manner similar to the first embodiment, occurrence of flicker is suppressed at low cost.

Moreover, as shown in FIGS. 19 to 22, the opposite AC driving can be employed as a method of driving a common electrode. Consequently, in a manner similar to the first embodiment, reduction in power consumption and low cost achieved by employing the source driver having relatively low withstand voltage are realized.

Further, in a manner similar to the first embodiment, in the case of employing a sub-pixel rendering method, the pitch (distance) between neighboring source bus lines becomes shorter, occurrence of a leak failure is suppressed, and power consumption is reduced.

Note that, in the embodiment, in place of the interlace driving, a driving method called the 2H dot inversion driving method can be also realized by sequential driving gate bus lines one by one.

3. Third Embodiment

3.1 About an Array of Pixels

Figure 27:
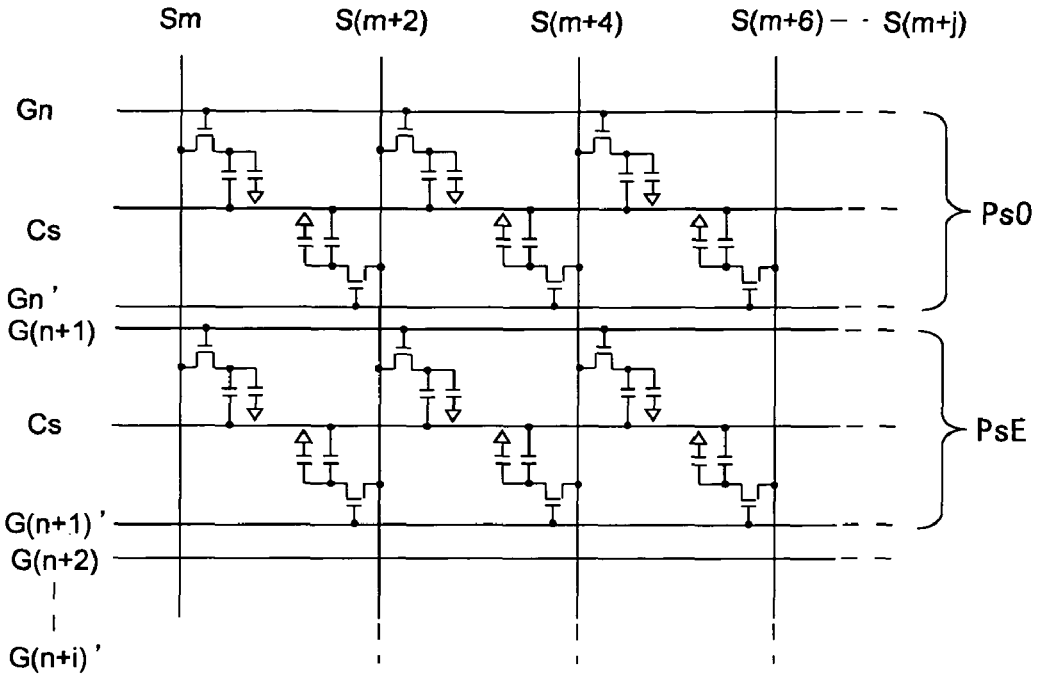
FIG. 27 is an equivalent circuit diagram showing the configuration of a part of a display unit in a liquid crystal display device according to a third embodiment of the invention.

The general configuration of a liquid crystal display device according to a third embodiment of the present invention is similar to that of the first embodiment, so that it will not be described. FIG. 27 is an equivalent circuit diagram showing the configuration of a part of the display unit 100 in the embodiment. In the embodiment, the array of pixels in the odd-numbered rows PsO is similar to that of the first embodiment shown in FIG. 1. On the other hand, the array of pixels in the even-numbered rows PsE is different from that of the first embodiment. In the embodiment, the array of pixels in the odd-numbered rows PsO and the array of pixels in the even-numbered rows PsE are similar to each other.

3.2 Driving Method

Figure 28:
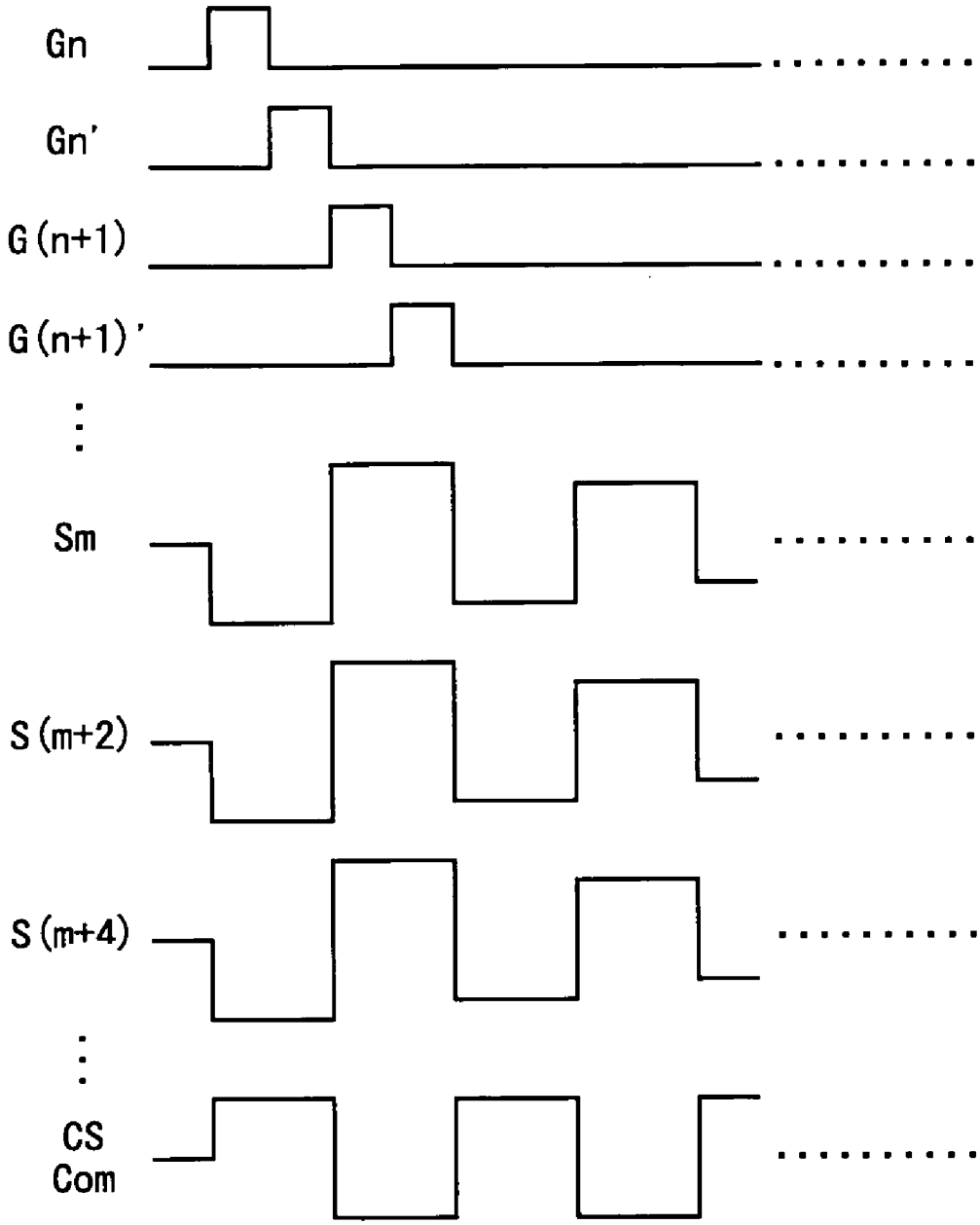
FIG. 28 is a signal waveform chart for explaining a driving method in the third embodiment.

FIG. 28 is a signal waveform chart for explaining a driving method in the embodiment. To gate bus lines, an active scanning signal is sequentially applied one-horizontal-scanning-period by one-horizontal-scanning-period. The polarity of the drive video signal is inverted every two horizontal scanning periods. In each horizontal scanning period, all of the polarities of drive video signals applied to the source bus lines are the same. With respect to a method of driving the common electrode, the opposite AC driving is employed. Note that, FIG. 28 shows the waveforms of signals in the odd-numbered frame. The polarity of the drive video signal in the even-numbered frame is opposite to that in the odd-numbered frame.

3.3 Effect

FIG. 29 is a polarity diagram in an odd-numbered frame. FIG. 30 is a polarity diagram in an even-numbered frame. As shown in FIGS. 29 and 30, display similar to that in the conventional line inversion driving method is performed. In the embodiment, although the number of gate bus lines is twice as many as that in a conventional general configuration, the number of source bus lines is the half. Consequently, while reducing the cost more than that in the conventional technique, without increasing power consumption, occurrence of flicker can be suppressed more than that in the frame inversion driving method.

3.4 Modifications

3.4.1 First Modification

Figure 31:
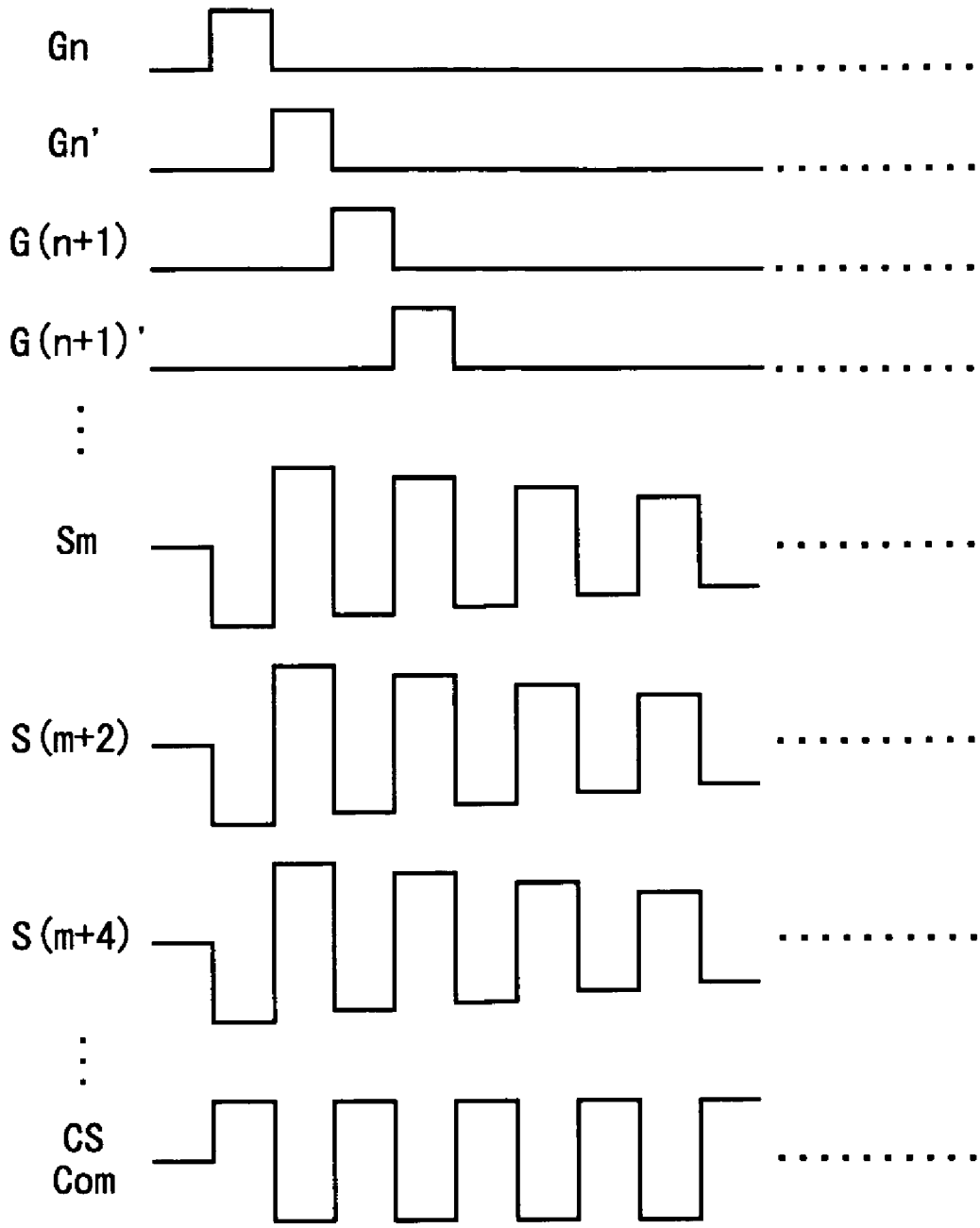
FIG. 31 is a signal waveform chart for explaining a driving method in a first modification of the third embodiment.

FIG. 31 is a signal waveform chart in a first modification of the third embodiment. To gate bus lines, an active scanning signal is sequentially applied one-horizontal-scanning-period by one-horizontal-scanning-period. The polarity of the drive video signal is inverted every horizontal scanning period. In each horizontal scanning period, all of the polarities of drive video signals applied to the source bus lines are the same. With respect to a method of driving the common electrode, the opposite AC driving is employed. Note that, FIG. 31 shows the waveforms of signals in the odd-numbered frame. The polarity of the drive video signal in the even-numbered frame is opposite to that in the odd-numbered frame.

FIG. 32 is a polarity diagram in an odd-numbered frame. FIG. 33 is a polarity diagram in an even-numbered frame. As shown in FIGS. 32 and 33, in one frame period, the polarities of pixels neighboring in the lateral (horizontal) direction are opposite to each other. Consequently, in a manner similar to the third embodiment, while reducing the cost more than that in the conventional technique, without increasing power consumption, occurrence of flicker can be suppressed more than that in the frame inversion driving method.

3.4.2. Second Modification

Figure 34:
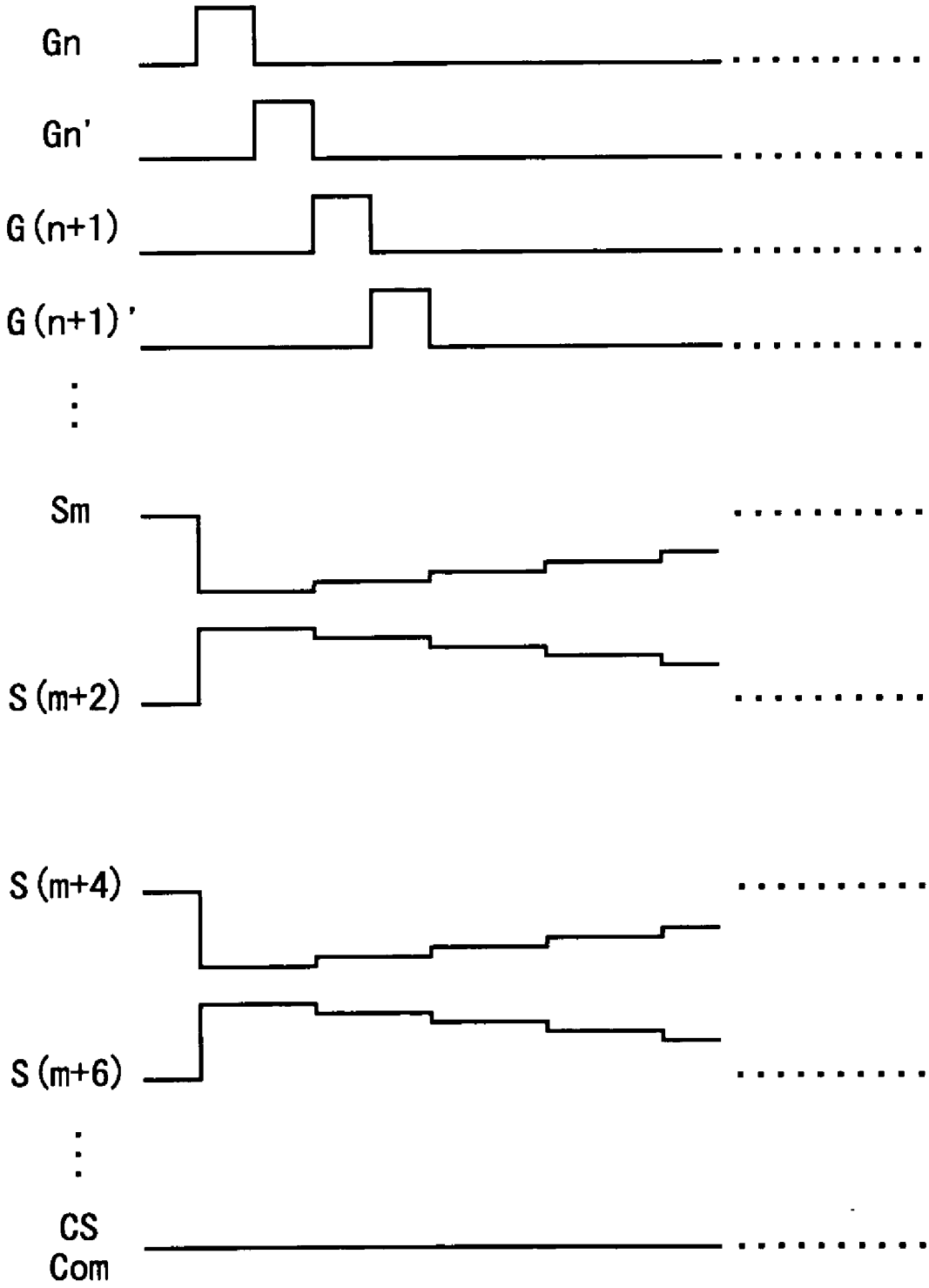
FIG. 34 is a signal waveform chart for explaining a driving method in a second modification of the third embodiment.

FIG. 34 is a signal waveform chart in a second modification of the third embodiment. To gate bus lines, an active scanning signal is sequentially applied one-horizontal-scanning-period by one-horizontal-scanning-period. With respect to the drive video signals, the drive video signals of the negative polarity are applied to odd-numbered source bus lines Sm, S(m+4), . . . , through one frame period, and the drive video signals of the positive polarity are applied to even-numbered source bus lines S(m+2), S(m+6), . . . through one frame period. With respect to a method of driving the common electrode, the opposite DC driving is employed. Note that, FIG. 34 shows the waveforms of signals in the odd-numbered frame. The polarity of the drive video signal in the even-numbered frame is opposite to that in the odd-numbered frame.

FIG. 35 is a polarity diagram in an odd-numbered frame. FIG. 36 is a polarity diagram in an even-numbered frame. As shown in FIGS. 35 and 36, the polarity is inverted every two columns in one frame period. Consequently, while reducing the cost more than that in the conventional technique, occurrence of flicker can be suppressed more than that in the frame inversion driving method.

The invention claimed is:

1. A display device having color filters formed by at least three primary colors, comprising:

a plurality of video signal lines for transmitting a video signal representing an image to be displayed;

a plurality of scanning signal lines crossing the plurality of video signal lines;

a video signal line drive circuit for applying the video signal to the plurality of video signal lines;

a scanning signal line drive circuit for selectively driving the plurality of scanning signal lines every horizontal scanning period;

a plurality of pixel formation portions disposed in a matrix using an extension direction of the plurality of video signal lines as a column direction and using an extension direction of the plurality of scanning signal lines as a row direction; and a display unit including the plurality of video signal lines, the plurality of scanning signal lines, and the plurality of pixel formation portions, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines, and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines, and the video signal line drive circuit makes all of polarities of video signals applied to each video signal line the same polarity in each horizontal scanning period and makes the polarity of a video signal applied to each video signal line vary between the case where a scanning signal line disposed on the upper side of any of the rows constructing the matrix is selected and the case where a scanning signal line disposed on the lower side of any of the rows constructing the matrix is selected in each vertical scanning period.

2. The display device according to claim 1, wherein the pixel formation portion pair of the first type and the pixel formation portion pair of the second type are repeated alternately in the extension direction of the plurality of video signal lines, and the scanning signal line drive circuit sequentially and selectively drives the plurality of scanning signal lines one by one.

3. The display device according to claim 1, wherein the pixel formation portion pair of the first type and the pixel formation portion pair of the second type are repeated twice alternately in the extension direction of the plurality of video signal lines, and the scanning signal line drive circuit selectively drives two each of scanning signal lines in the plurality of scanning signal lines while skipping two scanning signal lines.

4. The display device according to claim 1, further comprising a common electrode drive circuit for driving the common electrode so that the polarity of a voltage applied to the common electrode when a predetermined potential is set as a reference is inverted every horizontal scanning period, wherein the video signal line drive circuit applies the video signal to the plurality of video signal lines so that the polarity of the video signal when the potential of the common electrode is set as a reference is inverted every horizontal scanning period.

5. A display panel having a color filter formed by at least three primary colors, comprising:

a plurality of video signal lines for transmitting a video signal representing an image to be displayed;

a plurality of scanning signal lines crossing the plurality of video signal lines; and a plurality of pixel formation portions disposed in a matrix using an extension direction of the plurality of video signal lines as a column direction and using an extension direction of the plurality of scanning signal lines as a row direction, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines; and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, and the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines.

6. A method of driving a display device having color filters formed by at least three primary colors, a plurality of video signal lines for transmitting a video signal representing an image to be displayed, a plurality of scanning signal lines crossing the plurality of video signal lines, a plurality of pixel formation portions disposed in a matrix using an extension direction of the plurality of video signal lines as a column direction and using an extension direction of the plurality of scanning signal lines as a row direction, and a display unit including the plurality of video signal lines, the plurality of scanning signal lines, and the plurality of pixel formation portions, comprising:

a video signal line driving step of applying the video signal to the plurality of video signal lines; and a scanning signal line driving step of selectively driving the plurality of scanning signal lines every horizontal scanning period, wherein each pixel formation portion corresponds to any of crossing points between the plurality of video signal lines and the plurality of scanning signal lines, and includes:

a switching element being turned on and off according to a signal applied to a scanning signal line crossing the corresponding crossing point;

a pixel electrode connected to the video signal line passing the corresponding crossing point via the switching element; and a common electrode commonly provided for the plurality of pixel formation portions and disposed such that a predetermined capacitance is formed between the common electrode and the pixel electrode, two pixel formation portions which are neighboring in the lateral direction are provided per row between neighboring two video signal lines in the matrix formed by the plurality of pixel formation portions, two scanning signal lines are provided on the upper and lower sides of each of rows forming the matrix, with one line respectively in each side, arbitrary two pixel formation portions surrounded by two video signal lines which are neighboring each other and two scanning signal lines disposed on the upper and lower sides of each of rows of the matrix are formed by any of types of:

a pixel formation portion pair of a first type in which a switching element in a pixel formation portion disposed on the left side out of the two pixel formation portions is connected to the scanning signal line disposed on the upper side out of the two scanning signal lines and the video signal line disposed on the left side out of the two video signal lines, and a switching element in a pixel formation portion disposed on the right side out of the two pixel formation portions is connected to the scanning signal line disposed on the lower side out of the two scanning signal lines and the video signal line disposed on the right side out of the two video signal lines; and a pixel formation portion pair of a second type in which a switching element in a pixel formation portion disposed on the left side out of the two pixel formation portions is connected to the scanning signal line disposed on the lower side out of the two scanning signal lines and the video signal line disposed on the left side out of the two video signal lines, and a switching element in a pixel formation portion disposed on the right side out of the two pixel formation portions is connected to the scanning signal line disposed on the upper side out of the two scanning signal lines and the video signal line disposed on the right side out of the two video signal lines, the pixel formation portion pair of the first type and the pixel formation portion pair of the second type are alternately repeated K (K: natural number) times in the extension direction of the plurality of video signal lines, and the pixel formation portion pair of the first type or the pixel formation portion pair of the second type is repeated in the extension direction of the plurality of scanning signal lines, and in the video signal line driving step, all of polarities of video signals applied to each video signal line are made the same polarity in each horizontal scanning period and the polarity of a video signal applied to each video signal line is made vary between the case where a scanning signal line disposed on the upper side of any of the rows constructing the matrix is selected and the case where a scanning signal line disposed on the lower side of any of the rows constructing the matrix is selected in each vertical scanning period.

7. The driving method according to claim 6, wherein the pixel formation portion pair of the first type and the pixel formation portion pair of the second type are repeated alternately in the extension direction of the plurality of video signal lines, and in the scanning signal line driving step, the plurality of scanning signal lines are driven sequentially and selectively one by one.

8. The driving method according to claim 6, wherein the pixel formation portion pair of the first type and the pixel formation portion pair of the second type are repeated twice alternately in the extension direction of the plurality of video signal lines, and in the scanning signal line driving step, two each of the plurality of scanning signal lines are selectively driven while skipping two scanning signal lines.

9. The driving method according to claim 6, further comprising a common electrode driving step of driving the common electrode so that the polarity of a voltage applied to the common electrode when a predetermined potential is set as a reference is inverted every horizontal scanning period, wherein in the video signal line driving step, the video signal is applied to the plurality of video signal lines so that the polarity of the video signal when the potential of the common electrode is set as a reference is inverted every horizontal scanning period.

* * * * *